US007395002B2

(12) United States Patent
Funayama et al.

(10) Patent No.: US 7,395,002 B2
(45) Date of Patent: Jul. 1, 2008

(54) IMAGE FORMING APPARATUS AND OUTPUT IMAGE DENSITY CORRECTION METHOD

(75) Inventors: Yasuhiro Funayama, Saitama (JP); Makoto Kanai, Saitama (JP); Hisashi Fukasawa, Saitama (JP); Masaru Sakuma, Saitama (JP); Kiyoshi Nagamine, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 236 days.

(21) Appl. No.: 11/420,656

(22) Filed: May 26, 2006

(65) Prior Publication Data

US 2007/0081829 A1 Apr. 12, 2007

(30) Foreign Application Priority Data

Oct. 6, 2005 (JP) ..... 2005-293506
Nov. 11, 2005 (JP) ..... 2005-327275

(51) Int. Cl.
*G03G 15/00* (2006.01)
*G03G 15/08* (2006.01)

(52) U.S. Cl. ..... 399/49; 399/44

(58) Field of Classification Search ..... 399/27–30, 399/44, 49

See application file for complete search history.

(56) References Cited

U.S. PATENT DOCUMENTS 7,058,321 B2 * 6/2006 Kin ..... 399/27
2006/0245770 A1 * 11/2006 Choi ..... 399/27

FOREIGN PATENT DOCUMENTS

JP 5-210279 A 8/1993
JP 2004-318114 A 11/2001
JP 2004-109599 A 4/2004

* cited by examiner

*Primary Examiner*—Ryan Gleitz
(74) *Attorney, Agent, or Firm*—Sughrue Mion, PLLC

(57) ABSTRACT

An image forming apparatus including: an outputted image density control portion that forms a patch image and determines an outputted image density control condition based on a comparison result of the density of the patch image with a preliminarily set target value; a pixel count portion capable of counting the amount of image pixel at the time of image formation; a pixel count value accumulating memory portion that accumulates and stores the pixel count value; a toner supply portion; a toner supply amount measuring portion capable of measuring the amount of toner supplied to the developing device; a toner supply amount accumulating memory portion that accumulates and stores the toner supply amount; and a target value correcting portion that corrects the target value of the density of the patch image from the relation between a pixel count accumulating value and a toner supply amount accumulation value, is provided.

11 Claims, 14 Drawing Sheets

CASE IN WHICH IMAGE DENSITY IS CORRECTED

CASE INDICATING AN IDEAL OPERATION

CASE IN WHICH TONER SUPPLY AMOUNT IS LARGE AND IMAGE DENSITY IS HIGH.

CASE IN WHICH IMAGE DENSITY IS CORRECTED

CASE IN WHICH IMAGE DENSITY IS CORRECTED
(IN ENLARGEMENT)

IMAGE FORMING APPARATUS AND OUTPUT IMAGE DENSITY CORRECTION METHOD

CROSS-REFERENCE TO RELATED APPLICATION

This application claims priority under 35 USC 119 from Japanese Patent Application Nos. 2005-293506 and 2005-327275, the disclosures of which are incorporated by reference herein.

BACKGROUND

1. Technical Field

The present invention relates to an image forming apparatus having an image forming engine which forms an image by forming a static latent image by irradiating light beam corresponding to image data onto the surface of an image carrying body charged uniformly, developing that image with toner, transferring the toner image directly or through an intermediate transfer body and fixing the transferred toner image and, to an output image density correction method thereof.

2. Related Art

Conventionally, an image forming apparatus employing this kind of electronic photographing method such as a copier, printer, facsimile, or multi-function machine thereof includes a charging portion, light beam scanning portion, developing portion, transferring portion and the like, disposed around a photo conductor drum as an image carrying body such that they oppose the peripheral surface of this photo conductor drum.

That is, the surface of the photo conductor drum is charged uniformly by applying a predetermined voltage to the charging portion, a static latent image is formed with a light beam from the light beam scanning portion, that image is developed by supplying toner in the developing portion, the toner image is transferred to an intermediate transfer body or the like by the transfer portion, and then that image is finally transferred to a paper.

The paper to which the image is transferred is subjected to fixing processing by the fixing portion during the transportation up to a discharge port.

In such a conventional image forming apparatus, a method for adjusting toner density in the developing portion and output image density with a single light beam sensor (density sensor) has been invented for reduction of manufacturing cost and reduction of the apparatus size. A specific example includes forming a toner density adjustment patch and an image density adjustment patch at a predetermined interval, determining a toner density and image density by measuring these patch densities with the light beam sensor, and adjusting the toner density and image density corresponding to this determination result.

To stabilize the image quality, the technologies described have been proposed.

A first related art aims at obtaining uniformity of image density and fixing property so as to maintain image quality in printing at a high image ratio in order to stabilize the image quality with a simple structure.

That is, the structure of this related art includes a portion which counts the amount of dots, a memory which stores a dot count value, and a control portion which controls toner development bias, and the bias voltage is raised when the dot count value exceeds a predetermined value.

As a consequence, the apparatus of this related art counts the amount of dots of an outputted image each time and increments the count value at the memory portion and when this value exceeds a value when the image quality begins to drop, the apparatus raises its development bias so as to suppress the quality drop in the density.

A second related art has proposed improvement with respect to the drop in solid density or the drop in character image quality due to the charge-up of the developing agent because the amount of toner discharged (developed) is insufficient when a number of low density images which are nearly blank sheets are outputted, and improvement with respect to the increase of running cost due to the acceleration of toner consumption pace within the developing machine in the case of a high image density (because of reduction in the charge of the toner).

That is, when the amount of discharge is insufficient, the amount of toner calculated under the discharge mode (by the adjustment control of the developing machine) is discharged so as to consume toner of more than a predetermined amount for a specified number of sheets. If the amount of discharge is large, toner is charged by operating the developing machine for a predetermined time.

A third related art has proposed maintaining a specified printing performance by securing the density by correcting the development bias, which method is used in the field of electronic photographing type high-speed printers because the low density appears after a printing operation at a low printing ratio or an intermittent printing operation.

That is, the correction is executed step by step corresponding to a detection result of the developing agent consumption rate in order to prevent the tone jump caused by correction.

However, in the above-described image forming apparatus, actual toner density or image density often largely diverges from a target even though a measured value by the aforementioned light beam sensor is near a target toner density or image density. The reason for this is due to dispersion in the amount of developing agent (MOS) on a developing roll, a degree of scattering of a patch image, or dispersion in the developing agent, photo conductor, intermediate transfer member or the like, and in any case, if these values largely diverge from their target values, a variety of troubles occur in image quality.

Particularly if the image density is higher than the target value, there is not only a problem concerning the image quality such as the generation of a ghost or transfer failure but also a problem that the life of a toner cartridge cannot be satisfied because the amount of consumed toner is large.

The correction disclosed in the first related art is not sufficient since the correction is not conducted when the number of dots is smaller than a number at which the quality drop begins. Further, the related art does not teach means to conduct correction when the image density is high.

Further, the second related art has no effect in keeping constant image density during normal operation because it intends to suppress toner charge-up or an influence at the time of low charge.

Additionally, the third related art has no effect in keeping constant image density during normal operation because it intends to suppress toner charge-up or an influence at the time of low charge.

SUMMARY

In view of the above-described problems, an object of the present invention is to provide an image forming apparatus capable of stabilizing the density of an outputted image accurately over a long period even if there is dispersion in scattering of a patch image or dispersion of developing agent, photo conductor, intermediate transfer member or the like when the correction is executed based on the comparison result of the density of the patch image for outputted image density adjustment with a target value.

In addition to the above mentioned object, another object of the invention is to provide an image forming apparatus capable of stabilizing the density of an outputted image throughout the operating period of the apparatus, that is, irrespective of a transition period and a regular operating period and to provide a method for correcting the outputted image density.

[First Aspect of the Invention]

A first aspect of the invention provides an image forming apparatus having an image forming engine for forming an image by charging the surface of an image carrying body uniformly, forming a static latent image by irradiating a light beam to the uniformly charged image carrying body corresponding to image data, developing the image with toner by a developing device, transferring the toner image to a recording medium directly or through an intermediate transfer body and fixing the transferred toner image, the image forming apparatus including: an outputted image density control portion that forms a patch image for outputted image density correction and determines an outputted image density control condition based on a comparison result of the density of the patch image with a preliminarily set target value; a pixel count portion capable of counting the amount of image pixel at the time of image formation; a pixel count value accumulating memory portion that accumulates and stores the pixel count value obtained by counting by the pixel count portion; a toner supply portion capable of supplying the toner to a developing device quantitatively; a toner supply amount measuring portion capable of measuring the amount of toner supplied to the developing device by the toner supply portion; a toner supply amount accumulating memory portion that accumulates and stores the toner supply amount measured by the toner supply amount measuring portion; and a target value correcting portion that corrects the target value of the density of the patch image from the relation between a pixel count accumulating value stored in the pixel count value accumulating memory portion and a toner supply amount accumulation value stored in the toner supply amount accumulating memory portion.

According to the first aspect of the invention, the image density is controlled to a specified density even when the developing characteristics are affected by changes in the characteristics of the toner (including carrier) or a difference in the physical properties of a photo conductor by changing the target value of the outputted image density depending on the variation (this variation is referred to below as "inclination" because it can be expressed as a ratio of the toner supply amount accumulation value with respect to the pixel count accumulation value) computed from the pixel count accumulation value and the toner supply amount accumulation value. Further, because the image density, that is, the toner consumption amount, is improved with the variation (inclination) getting into a certain range, the generation of such a problem that the service life of the toner cartridge does not reach a target service life due to outputted image density being too high can be suppressed.

(Principle of the First Aspect of the Invention)

The principle of the first aspect of the invention will be described below.

FIG. 7 shows the relation between the pixel count accumulation value and the toner supply amount accumulation value when the pixel count accumulation value is set on the abscissa axis and the toner supply amount accumulation value is set on the ordinate axis. The dashed line indicates an upper limit value of the toner supply amount accumulation value and, that is, if an actual toner supply amount accumulation value exceeds this line, it indicates that the toner supply amount is excessive, the developing amount is large and the outputted image density is high.

FIG. 7 shows a case where the actual toner supply amount represented by the solid line is slightly lower than the dashed line, thereby indicating that almost expected toner consumption, that is, expected outputted image density, is secured.

FIG. 8 indicates that the actual toner supply amount is over the dashed line, meaning that the toner consumption is large, that is, the outputted image density is too high. If the density of the patch image used for the outputted image density control is higher than the target value, the apparatus controls to lower the outputted image density, and as a consequence, the toner consumption is suppressed and the toner supply amount is also corrected in the direction toward the dashed line.

However, if the development characteristics change due to changes in the characteristics of the toner (including carrier) developing agent, or the physical properties of the photo conductor and the intermediate transfer body, the density of the patch image used for outputted image density control is sometimes determined to be coincident with the target value even if the actual outputted image density is high. Because the outputted image density can not be corrected in such a case, the image continues to be shifted in a high density, thereby producing problems in the image quality such as transfer ghost, transfer failure or a problem in that the service life of the toner cartridge is not satisfied.

FIG. 9 shows the operation of the apparatus of the first aspect, in which although the actual toner supply amount is over the dashed line in an initial period, the outputted image density is corrected so that the toner consumption is changed, and consequently, the variation (inclination) of the toner supply cumulative value with respect to the actual pixel count cumulative value changes without exceeding the inclination of the upper limit value.

FIG. 10 shows an enlargement of FIG. 9, indicating that when a preliminarily specified pixel count cumulative value is reached, the variation (inclination) of the toner supply cumulative value with respect to the actual pixel count cumulative value is compared with the inclination of the toner supply amount upper limit value, and the variation (inclination) of the toner supply amount cumulative value with respect to the pixel count cumulative value is changed by changing the target value of the outputted image density depending on the condition.

[Second Aspect of the Invention]

A second aspect of the invention provides an image forming apparatus having an image forming engine for forming an image by charging the surface of an image carrying body uniformly, forming a static latent image by irradiating a light beam to the uniformly charged image carrying body corresponding to image data, developing the image with toner by a developing device, transferring the toner image to a recording medium directly or through an intermediate transfer body and fixing the transferred toner image, the image forming apparatus including: a standard outputted image density control condition data memory portion that stores the relation between an environmental condition and an outputted image density control condition under a known toner density; an outputted image density control portion that forms a patch image for outputted image density correction and determines the outputted image density control condition based on the comparison result of the density of the patch image with a preliminarily set target value; an environmental sensor that detects at least the humidity of the environment under which the images forming engine is constituted; a standard outputted image density condition reading portion that reads out a standard outputted image density control condition under the environmental condition including the humidity detected by the environmental sensor based on the standard outputted image density control condition data memory portion, in which at least the toner density is known and in which the reading out is executed in a preliminarily determined apparatus operation transition period; and a target value correcting portion that corrects the target value of the density of the patch image based on the difference between the standard outputted image density control condition read out by the standard outputted image density condition reading portion and the outputted image density control condition determined by the outputted image density control portion.

(Outline of the Second Aspect of the Invention)

The second aspect of the invention is executed specifically in the apparatus operation transition period while the first aspect of the invention is executed constantly and periodically during the operation of the apparatus. As a consequence, the correction of the target value by the first aspect of the invention can be stabilized rapidly.

That is, in the apparatus operation transition period, for example, when the image forming apparatus has just come under control by a user after it is shipped from the factory, consumption of toner is extremely small (including no use) and the amount of processing is extremely small (including no processing), and thus, the relation between the image and the toner consumption amount has not yet been grasped. In other words, speaking in terms of the amount of processing, image forming operation for several hundred sheets is needed to grasp this relation.

If the first aspect of the invention is executed, it takes an extremely large amount of time for the target value to converge from such an apparatus operation transition period to a stable value. This does not deny the first aspect but clarifies that the apparatus operation transition period is less efficient than the regular period.

(Operation of the Second Aspect of the Invention)

According to the second aspect of the invention, the relation between the environmental condition and the outputted image density control condition under a known toner density is stored in the standard outputted image density control condition data storage portion.

Here, in a preliminarily set apparatus operation transition period in which at least the toner density is known, after the outputted image density control condition is determined by the outputted image density control portion, the standard outputted image density condition reading portion reads out the standard outputted image density control condition of the environmental condition including humidity detected by the environmental sensor from the standard outputted image density control condition data storage portion.

The target value correcting portion corrects the target value of the density of the patch image based on the difference between the standard outputted image density control condition read out by the standard outputted image density condition reading portion and the outputted image density control condition determined by the outputted image density control portion.

In the apparatus operation transition period, because a difference with respect to the standard outputted image density condition occurs depending on the environmental condition due to the toner density being known (due to the toner cartridge being new), the target value can be approximated to an optimum value by a certain amount of estimation.

[Third aspect of the Invention]

A third aspect of the invention provides an outputted image density correcting method that is executed at a predetermined timing throughout an entire apparatus operation so as to form a patch image for outputted image density correction and determine an outputted image density control condition according to the comparison result of the density of the patch image with a preliminarily set target value, in an image forming apparatus having an image forming engine for forming an image by charging the surface of an image carrying body uniformly, forming a static latent image by irradiating a light beam to the uniformly charged image carrying body corresponding to image data, developing the image with toner by a developing device, transferring the toner image to a recording medium directly or through an intermediate transfer body and fixing the transferred toner image, the method including: obtaining a difference between an environmental condition when the outputted image density control condition is determined and a standard outputted image density control condition under conditions in which the toner density is known in a preliminarily set apparatus operation transition period and correcting the target value based on the difference; and accumulating the amount of image pixels at the time of image formation in a period other than the apparatus operation transition period, accumulating the toner supply amounts supplied to the developing device and correcting the target value of the density of the patch image according to the relation between the accumulation value of the pixel amount and the accumulation value of the toner supply amount.

The third aspect of the invention enables a stable target value to be maintained throughout the entire operation of the apparatus by combining the first aspect and second aspect of the invention.

More specifically, because the apparatus operation transition period comes first, the second aspect of the invention is executed in this apparatus operation transition period, and then, the first aspect is executed.

BRIEF DESCRIPTION OF THE DRAWINGS

Preferred embodiments of the invention will be described in detail based on the following figures, wherein.

DETAILED DESCRIPTION OF THE INVENTION

First Embodiment (Schematic Structure of Image Forming Apparatus)

Figure 1:
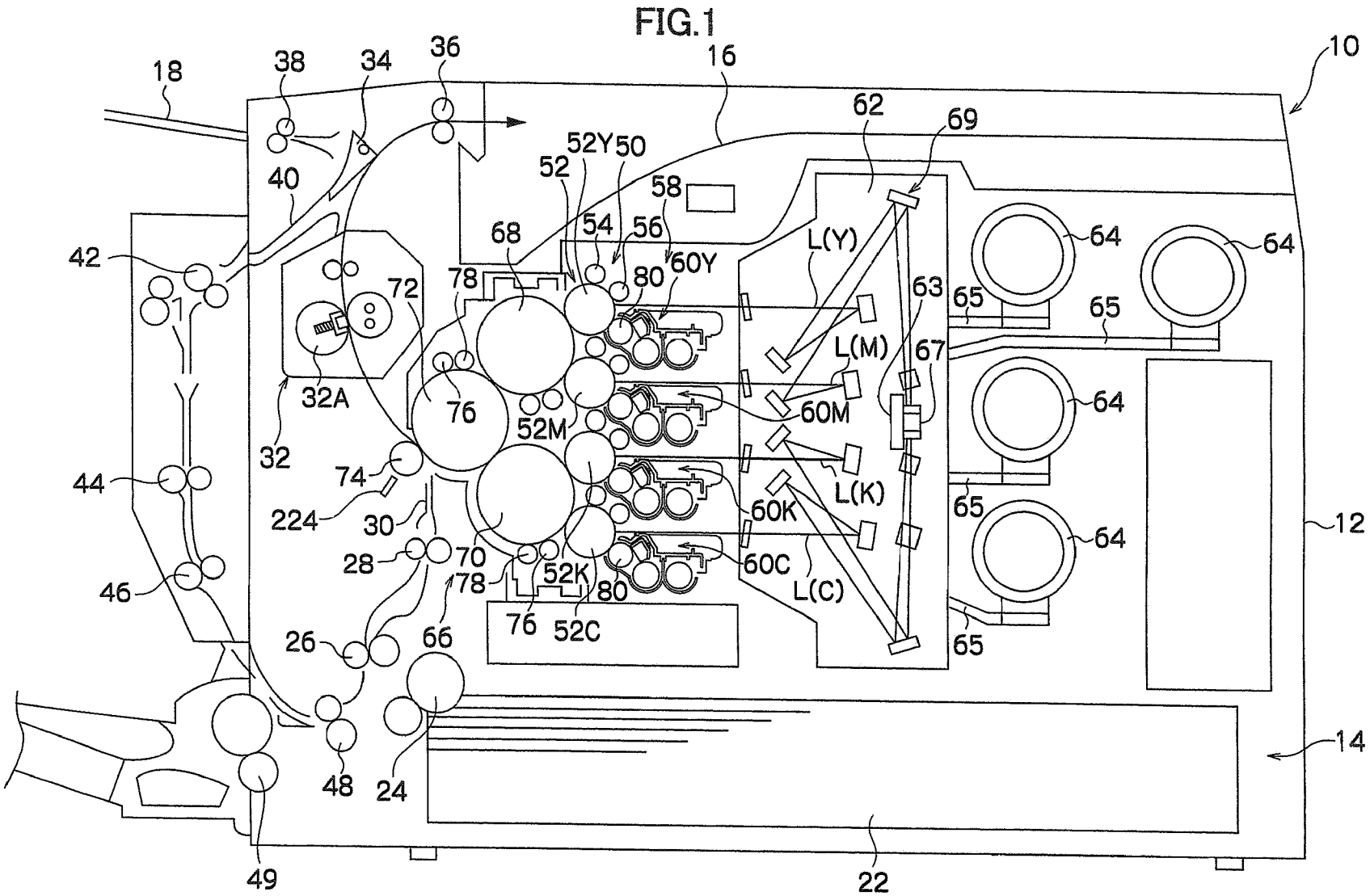
FIG. 1 is a side view showing an image forming apparatus according to a first embodiment of the present invention.

FIG. 1 shows an outline of an image forming apparatus 10 according to a first embodiment of a first aspect of the invention. The image forming apparatus 10 includes an engine portion 12, and a paper feeding unit 14 is provided at the bottom of the engine portion 12.

This paper feeding unit 14 includes a paper tray 22 in which papers are stacked and a paper feeding roll 24 for feeding papers from the paper tray 22. A paper fed from the paper feeding roll 24 passes a paper feeding passage 30 through paper carrying rolls 26, 28 and is carried to a transfer roll 74.

A toner image is transferred to a paper by this transfer roll 74 and fixed by a fixing roll 32A of a fixing portion 32. After that, the paper is discharged to a first discharge tray 16 or a second discharge tray 18 provided on the top of the engine portion 12 by a discharge roll 36 or a discharge roll 38 based on the selection of the position of a switching pawl 34.

In the case of double-sided printing, after the printing of the front surface is ended in the above-described steps, the discharge roll 36 is reversed before the paper is discharged completely to the first discharge tray 16, and the paper is supplied to a reverse passage 40. Then, the paper is returned to the paper feeding passage 30 through carrying rolls 42, 44, 46, 48, and the rear surface of the paper is printed. In the case of manual feed printing, when a paper is placed on a manual feed tray 20, the paper is carried from a manual feeding roll 49 to the paper feeding passage 30 through the carrying roll 48 and printed.

In the fixing portion 32, the fixing roll 32A is heated up to a predetermined temperature by lighting of a lamp (for example, a halogen lamp or the like), so that the toner image is fixed to the paper with heating and pressurization by the heated fixing roll 32A.

Four toner cartridges 64 filled with developing agent of each color (composed of toner and magnetic carrier) are disposed on the right of the image forming apparatus 10 in FIG. 1. These toner cartridges 64 are connected to developing devices 60Y, 60M, 60K, 60C disposed in order from the top in FIG. 1, which will be described later, and the developing agents in the toner cartridges 64 are supplied to the developing devices 60Y, 60M, 60K, 60C.

An exposure unit 62 is disposed on the left of the toner cartridges 64 in FIG. 1, and four laser beams L(Y), L(M), L(K), L(C) corresponding to an image signal are emitted from the exposure unit 62 to photo conductor drums 52Y, 52M, 52K, 52C (hereinafter generally referred to as just 52) constituting the photo conductor unit 50 disposed on the left of the exposure unit 62 in FIG. 1 so as to form a latent image on the photo conductor drum 52.

The photo conductor drums 52 are for yellow (52Y), magenta (52M), black (52K) and cyan (52C) in order from the top in FIG. 1.

The exposure unit 62 includes a light source portion which outputs laser beams L(Y), L(M), L(K), L(C) (hereinafter generally referred to as laser beam L) of the respective colors Y, M, K, C, a modulation processing portion which modulates the laser beam L and emits for scanning, and an optical system constituted of fθ lenses for correcting the scanning velocity on an exposure surface and a cylindrical lens for face tangle error correction having lens power in the scanning direction and the like.

In the exposure unit 62, the laser beam L of each color emitted from the light source portion is incident upon the modulation processing portion, is modulated based on the image information of each color, and then is passed for scanning (main scanning) by a polygon mirror 67 rotated by a polygon motor 63. The laser beam L of each color scanned by the polygon mirror 67 is reflected by a mirror group 69 toward the photo conductor drums 52 corresponding to each color and focused on each photo conductor drum 52.

The photo conductor unit 50 has a charging roll 56 and a refresh roll 54 corresponding to each photo conductor drum 52 (in FIG. 1, only components corresponding to the photo conductor unit 50Y are expressed with reference numerals), which are provided so that each of them makes rotating contact with the photo conductor drum 52. The charging roll 56 charges the photo conductor drum 52 uniformly so as to attach toner scattered from a magnet roll 80 provided in a developing device 58 to the surface of the photo conductor drum 52. On the other hand, the refresh roll 54 discharges the photo conductor drum 52 so as to remove the residual toner adhering to the surface of the photo conductor drum 52, thereby preventing a ghost or the like which is generated due to the residual toner on the surface of the photo conductor drum 52.

The developing device 58 is disposed on the right bottom of each photo conductor unit 50 in FIG. 1, and four developing devices 60Y, 60M, 60K, 60C are arranged vertically so as to correspond to the respective photo conductor drums 52 (52Y, 52M, 52K, 52C).

On the other hand, an intermediate transfer unit 66 is disposed on the left of the photo conductor unit 50 in FIG. 1, including three drum-like intermediate transfer bodies 68, 70, 72. The two first intermediate transfer bodies 68, 70 are arranged vertically in line, and the upper first intermediate transfer body 68 keeps rotating contact with the two photo conductor drums 52Y, 52M disposed at upper positions among the photo conductor drums 52 while the lower first intermediate transfer body 70 keeps rotating contact with the two photo conductor drums 52K, 52C disposed at lower positions. The second intermediate transfer drum 72 keeps rotating contact with both of the first intermediate transfer bodies 68, 70, and the transfer roll 74 described previously keeps rotating contact with this second intermediate transfer drum 72.

Thus, the respective toner images are transferred from the photo conductor drums 52Y, 52M to the first intermediate transfer body 68, and transferred from the photo conductor drums 52K, 52C to the first intermediate transfer body 70. Each toner image with two colors transferred to each of the first intermediate transfer bodies 68, 70 is transferred to the second intermediate transfer drum 72 so that the four colors are gathered, and the toner image with four colors is transferred to a paper by the transfer roll 74.

A cleaning roll 76 and a cleaning brush 78 are disposed near each of these intermediate transfer bodies 68, 70, 72 so as to scrape the residual toner on the surface of the intermediate transfer bodies 68, 70, 72.

(Schematic Structure of Control System of Entire Image Forming Apparatus)

Figure 2:
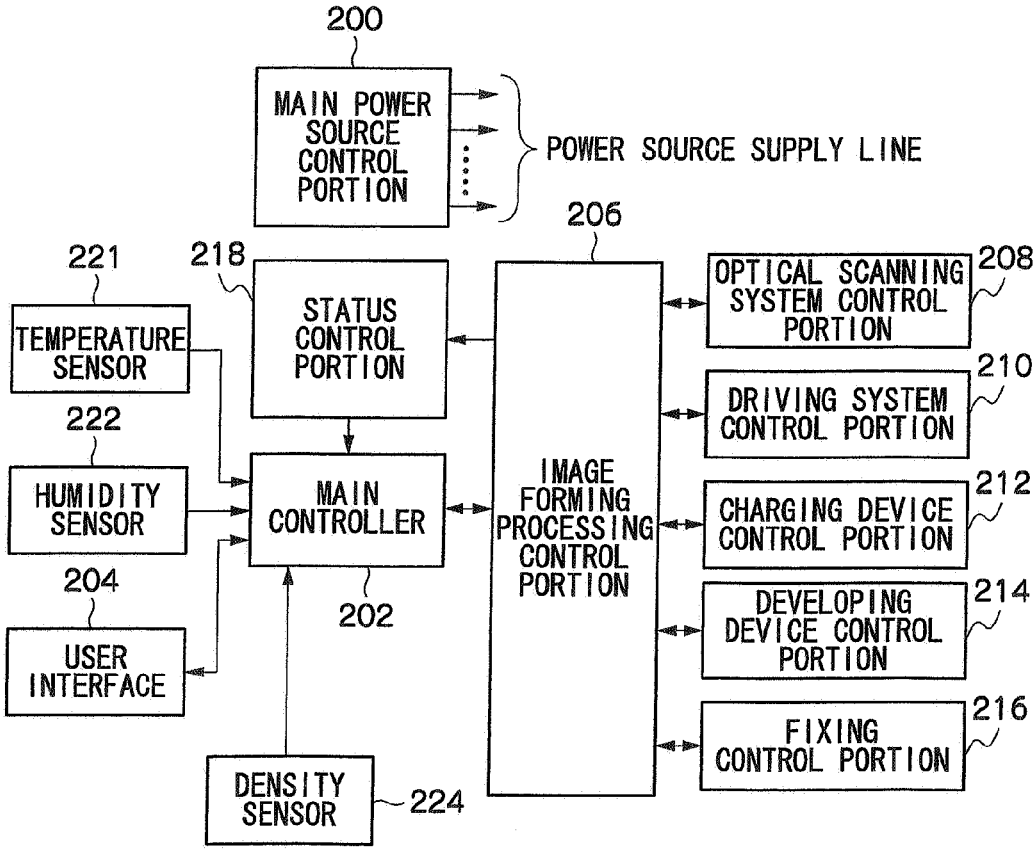
FIG. 2 is a control block diagram of an engine portion according to the first embodiment of the present invention.

FIG. 2 is a block diagram of a control system for image formation in the engine portion 12.

A commercial power source (not shown) is connected to a main power source control portion 200 so as to generate a low voltage power source (LVPS) and a high voltage power source (HVPS), and these power sources supply power to respective portions through power supply lines.

A user interface 204 is connected to a main controller 202 for a user to carry out instruction for the image formation or the like by operating this interface and to be notified of information at the time of the image formation or the like.

A network line to an outside host computer (not shown) is connected to this main controller 202 so as to input image data.

When image data is inputted, for example, the main controller 202 analyzes the print instruction information contained in the image data and the image data, and converts them into a style suitable for the engine 12 (for example, bit map data) and sends the image data to an image forming processing control portion 206 which constitutes a part of the MCU.

The image forming processing control portion 206 synchronously controls an optical scanning system control portion 208, a driving system control portion 210, a charging device control portion 212, a developing device control portion 214 and a fixing control portion 216, which constitute the MCU based on the inputted image data so as to execute image formation.

A status control portion 218 is connected to the image forming processing control portion 206 so as to judge the operating condition of the engine portion 12 (for example, processing mode ON, sleep mode ON, activating from sleep mode, processing ON and the like). The operating condition judged by the status control portion 218 is sent to the main controller 202.

To detect an environment, a temperature sensor 221 and a humidity sensor 222 are connected to the main controller 202. The temperature sensor 221 and the humidity sensor 222 detect the environmental temperature and the humidity within the engine portion 12.

Additionally, a density sensor 224 necessary for the outputted image density correction and the toner density correction is connected to the main controller 202. This density sensor 224 is disposed such that its detection face opposes the peripheral face of the second intermediate transfer drum 72. That is, this density sensor 224 is of the reflection type, which emits light beam to the transfer roll 74 and detects its reflection light so as to output an electric signal corresponding to its density value.

The outputted image density correction mentioned here is for determining whether or not the density of an image printed on a paper is ultimately recorded with the same density as that of the image data. In this process, first, a patch image (intermediate tone image) for the outputted image density detection is formed in a state in which no paper is carried, and is transferred to the transfer roll 74. Next, the density of the patch image on this transfer roll 74 is detected by the density sensor 224. The detected density data is compared with an outputted image density target value so as to correct the amount of light, the developing bias and the like.

On the other hand, the toner density correction mentioned here is for determining whether or not the amount of the unit supply of toner in the developing device 58 is appropriate. In this process, first, a patch image (solid image) for the toner density detection is formed in a state in which no paper is carried, and is transferred to the transfer roll 74. Next, the density of the patch image on the transfer roll 74 is detected with the density sensor 224. The detected density data is compared with a toner density target value so as to correct the amount of the supplied toner per pixel.

The first embodiment pays attention to the outputted image density correction among the above-described two kinds of correction styles so as to attempt to optimize the outputted image density correction.

That is, conventionally, the density data detected by the density sensor 224 was corrected depending on a difference between that density and a fixed target value of the outputted image. However, the comparison with such a fixed outputted image density target value affects the image quality seriously if the differences are accumulated.

Then, the fixed outputted image density target value is corrected depending on a cumulative value of the toner supply amount to the cumulative pixel count corresponding to the image data so as to eliminate the accumulated error.

(Outputted Image Density Target Value Correction Control System)

Figure 3A:
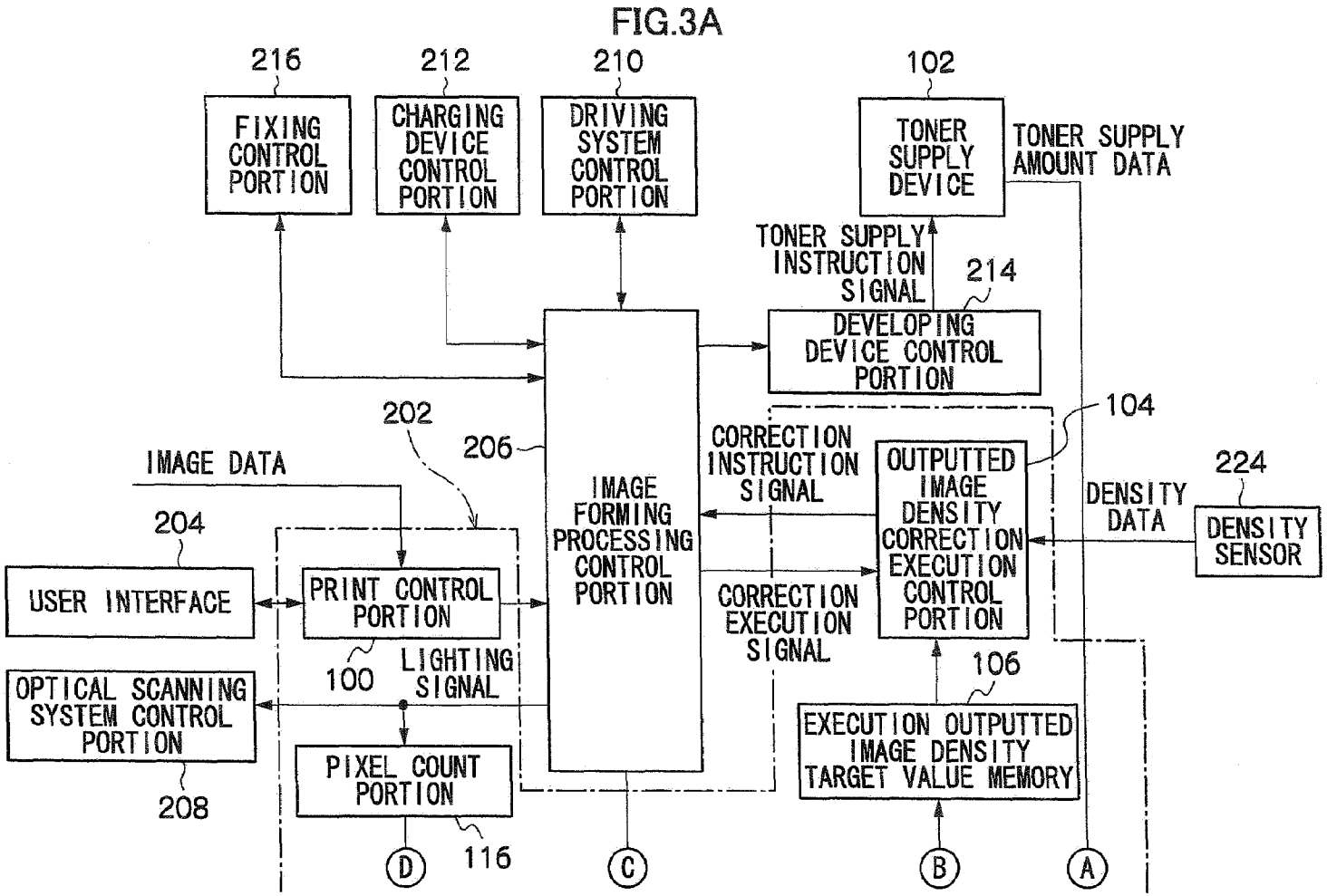
FIG. 3 is a block diagram showing an outputted image density correction control and an actual target value correction control functionally in a main controller according to the first embodiment of the present invention.
Figure 3B:
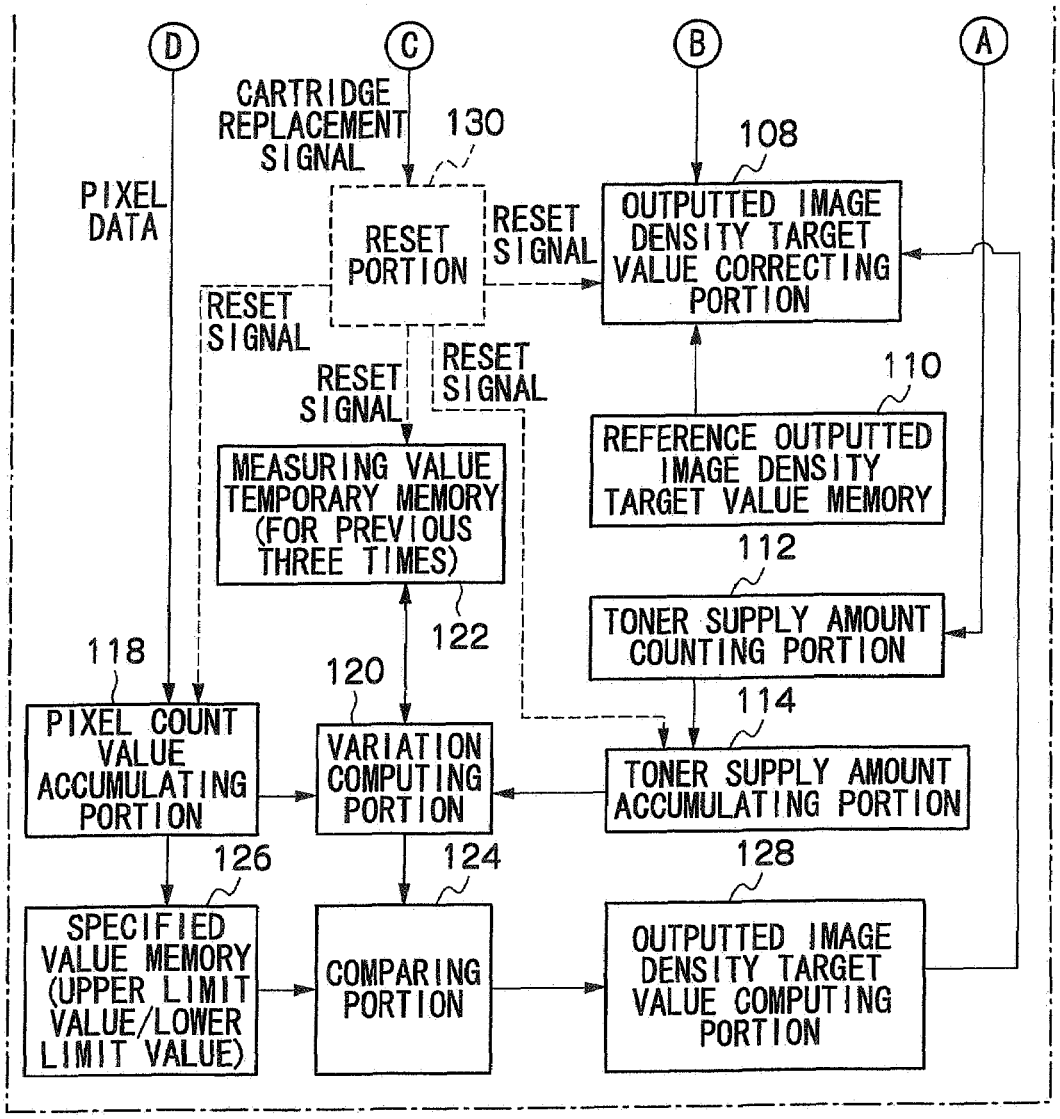

FIG. 3 is a block diagram showing the outputted image density target value correction control system in the main controller 202 functionally. This block diagram divides the processings necessary for the outputted image density target value correction control from the viewpoints of functions and does not restrict the hardware configuration.

The image data is inputted to a print control portion 100 of the main controller 202. The print control portion 100 is connected to the user interface 204. If a print instruction is provided from the user interface 204, the print control portion 100 instructs the execution of printing to the image forming processing control portion 206.

The image forming processing control portion 206 controls the fixing control portion 216, the charging device control portion 212, the driving system control portion 210, the developing device control portion 214 and the optical scanning system control portion 208 so as to execute the print processing as described previously (see FIG. 2). A toner supply device 102 is connected to the developing device control portion 214 so as to control the supply amount of toner from the toner cartridge 64 to the developing device 58 (developing devices 60Y, 60M, 60K, 60C).

An outputted image density correction execution control portion 104 is connected to the image forming processing control portion 206. The density data detected by the density sensor 224 is inputted to this outputted image density correction execution control portion 104. If an outputted image density correction patch image is formed at a predetermined timing, the density of this outputted image density correction patch image (hereinafter referred to as patch density) will be detected by the density sensor 224.

An execution outputted image density target value memory 106 is connected to the outputted image density correction execution control portion 104. A reference outputted image density target value is stored into this execution outputted image density target value memory 106 from a reference outputted image density target value memory 110 through an execution outputted image density target value correcting portion 108, which will be described later, in an initial condition (for example, when the toner cartridge 64 is replaced).

The outputted image density correction execution control portion 104 compares a patch density detected by the above-described density sensor 224 with an execution outputted image density target value (hereinafter referred to as actual target value) read out from the execution outputted image density target value memory 106 and feeds back a correction instruction signal to the image forming processing control portion 206 based on the comparison result thereof in order to correct the amount of light, the developing bias and the like based on its comparison result. As a consequence, the outputted image density can be stabilized.

Incidentally, if the outputted image density correction is executed repeatedly over a long period, accumulated error may occur. This accumulated error may gradually deflect the image density from an appropriate value so as to make the density of the outputted image unstable.

The first embodiment does not have to make the actual target value a fixed value in order to eliminate the accumulated error but instead can correct the accumulated error variably.

Thus, the supply amount of toner to be supplied by the toner supply unit 102 to the developing device (toner supply amount data) is counted by the toner supply amount counting portion 112, and that count value is accumulated by a toner supply amount accumulating portion 114. At the same time, the image data (pixel data) at the time of the image formation by the image forming processing control portion 206 is counted by the pixel count portion 116, and the count value is accumulated by the pixel count accumulating portion 118. In the meantime, the pixel data is applied as minimum unit data for determining the amount of toner.

The toner supply amount cumulative data accumulated by the toner supply amount accumulating portion 114 and the pixel cumulative data accumulated by the pixel count value accumulating portion 118 are inputted to a variation computing portion 120.

A measuring value temporary memory 122 is connected to this variation computing portion 120. This measuring value temporary memory 122 stores the toner supply amount data and the pixel cumulative data of the previous three times except in the transition period.

The variation computing portion 120 computes the variation from the updated toner supply amount cumulative data and the pixel cumulative data acquired the current time and the toner supply amount data and the pixel cumulative data of the previous three times and sends the variation to a comparing portion 124. The reason for applying the toner supply amount cumulative data and the pixel cumulative data of the previous three times is to raise the accuracy of the variation to be computed (raising the accuracy of an inclinating approximate curve), and in the transition period, the variation may be computed from the data preceding the previous two times.

A specified value memory 126 is connected to the comparing portion 124. This specified value memory 126 memorizes the specified values (upper limit value, lower limit value) for comparing the computed variations. The specified value memory 126 sends out the upper limit value and the lower limit value of a specified value corresponding to the current pixel count cumulative data based on information from the pixel count value accumulating portion 118 to the comparing portion 124, and the computed variation is compared with each of the upper limit value and the lower limit value of the specified value. As a consequence, three kinds of the comparison results, which are whether the variation is over the upper limit value, whether the variation is below the lower limit value and whether the variation is located between the upper limit value and the lower limit value, are sent to the outputted image density target value computing portion 128 (see FIG. 5).

The outputted image density target value computing portion 128 generates actual target value correction data for lowering the image density if the variation is over the upper limit value as a result of the comparison and on the other hand, if the variation is below the lower limit value, generates actual target value correction data for intensifying the image density and sends them to the outputted image density target value correcting portion 108.

This outputted image density target value correcting portion 108 is connected to the execution outputted image density target value memory 106. When the actual target correction data is inputted, the outputted image density target value correcting portion 108 corrects the actual outputted image density target value stored in the execution outputted image density target value memory 106.

A reset portion 130 is connected to the image forming processing control portion 206. If the image forming processing control portion 206 recognizes a replacement of the toner cartridge 64, it sends out a cartridge replacement signal to this reset portion 130.

If the cartridge replacement signal is inputted, the reset portion 130 sends out a reset signal to the pixel count value accumulating portion 118, the toner supply amount accumulating portion 114 and the measuring value temporary memory 122, and the data stored in each of these is reset. Further, the reset portion 130 sends out a reset signal to the outputted image density target value correcting portion 108. When this reset signal is received, the outputted image density target value correcting portion 108 reads out the reference outputted image density target value stored in the reference outputted image density target value memory 110 and stores it to the execution outputted image density target value memory 106.

That is, when the toner cartridge 64 is replaced, all data concerning the correction of the actual target value is cleared (reset) so as to return the status to an initial status.

Hereinafter, the operation of the first embodiment will be described.

(Flow of Image Forming Processing)

The image formation (print) process for each color by a well known electronic photographing method is carried out around each photo conductor drum 52 as follows.

First, each photo conductor drum 52 is driven at a predetermined rotation speed.

Then, the surface of the photo conductor drum 52 is charged uniformly to a predetermined level by applying a direct current with a predetermined charging level (for example, about −800V) to the charging roll 56. Although according to the first embodiment, only the direct current is applied to the charging roll 56, this embodiment can also be constructed to superimpose an alternate current component on the direct current component.

Next, laser beam L corresponding to each color is irradiated to the surface of each photo conductor drum 52 with a uniform surface potential by the exposure unit 62 so that the static latent image corresponding to the image information of each color is formed. As a consequence, the surface potential at a portion exposed to the laser beam L of the photo conductor drum 52 is removed up to a predetermined level.

The static latent image formed on the surface of each photo conductor drum 52 is developed by each corresponding developing device 58 so that the toner image of each color is visualized on each photo conductor drum 52.

Next, the toner image of each color formed on each photo conductor drum 52 is transferred primarily onto the corresponding first intermediate transfer drums 68, 70 statically. As a consequence, the toner images of Y color and M color formed on the photo conductor drums 52Y, 52M are transferred to the first intermediate transfer drum 68 and the toner images of K color and C color formed on the photo conductor drums 52K, 52C are transferred to the first intermediate transfer drum 70.

After that, the toner images formed on the first intermediate transfer drums 68, 70 are second transferred to the second intermediate transfer drum 72 statically. As a result, the toner images including single color images and images in which four colors Y, M, K, C are superimposed are formed on the second intermediate transfer drum 72.

Finally, the toner image formed on the second intermediate transfer drum 72 is tertiarily transferred to a paper passing the paper carrying passage by the transfer roll 74. After the tertiary transfer, the toner image formed on the paper is heated and fixed by the fixing unit 32, and then the image forming process is ended.

(Outputted Image Density Correction Control)

Although theoretically, an appropriate outputted image density is always maintained because the image recorded on the paper is developed based on the image data under a specified supply of toner to the developing device 58 and a predetermined developing bias actually, the outputted image density changes depending on the environmental temperature, deterioration of each component with elapse of time, error in toner supply amount, change in the developing bias and the like.

Thus, in order to correct the outputted image density periodically, an outputted image density correction patch image is formed, transferred to the transfer roll 74, and detected by the density sensor 224. The detected result is compared with a predetermined target value (actual target value) so as to correct the amount of light and the developing bias.

Basically, a stabilized outputted image density can be obtained by this outputted image density correction control.

(Outputted Image Density Target Value Correction)

However, if the outputted image density correction is continued over a long period, accumulated error occurs so that no appropriate image density may be obtained. Thus, according to the first embodiment, every time the pixel count cumulative data reaches a predetermined value, whether or not the toner supply amount cumulative value maintains its specified value (in a range from the upper limit value to the lower limit value) is determined, and if it departs from that specified value, the actual target value is corrected.

Figure 4A:
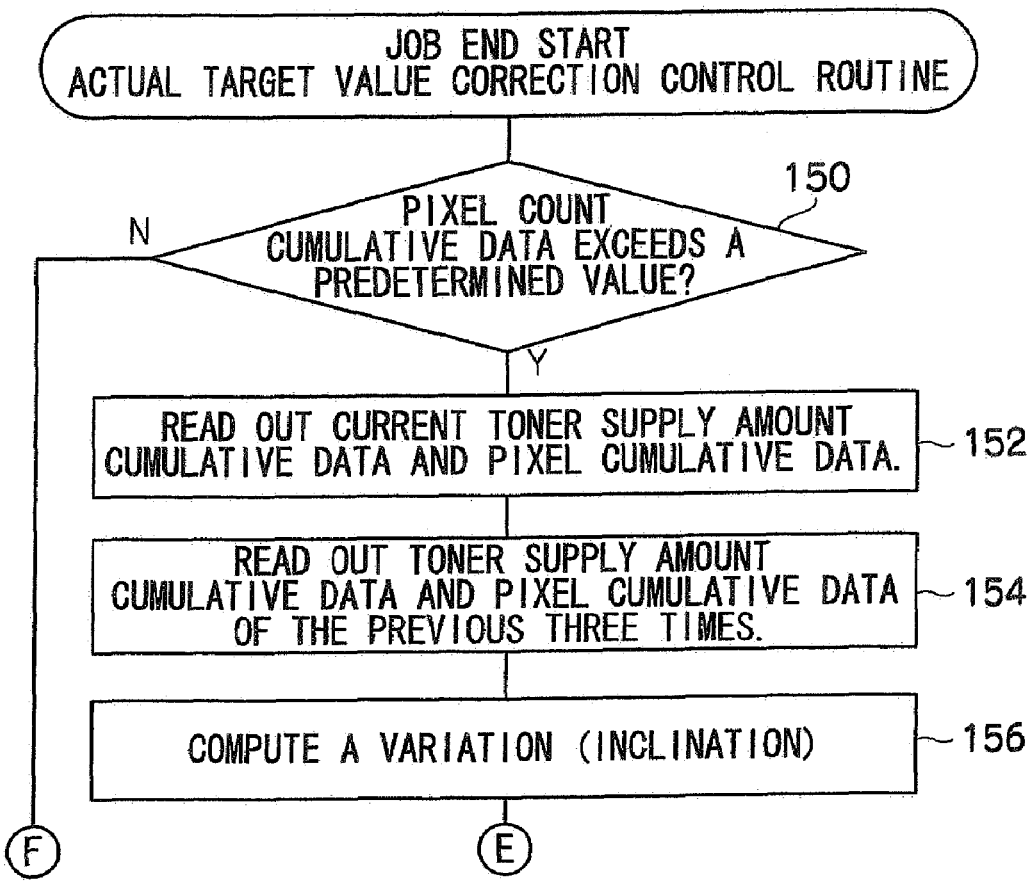
FIG. 4 is a flow chart showing the flow of the correction control of the actual target value according to the first embodiment of the present invention.
Figure 4B:
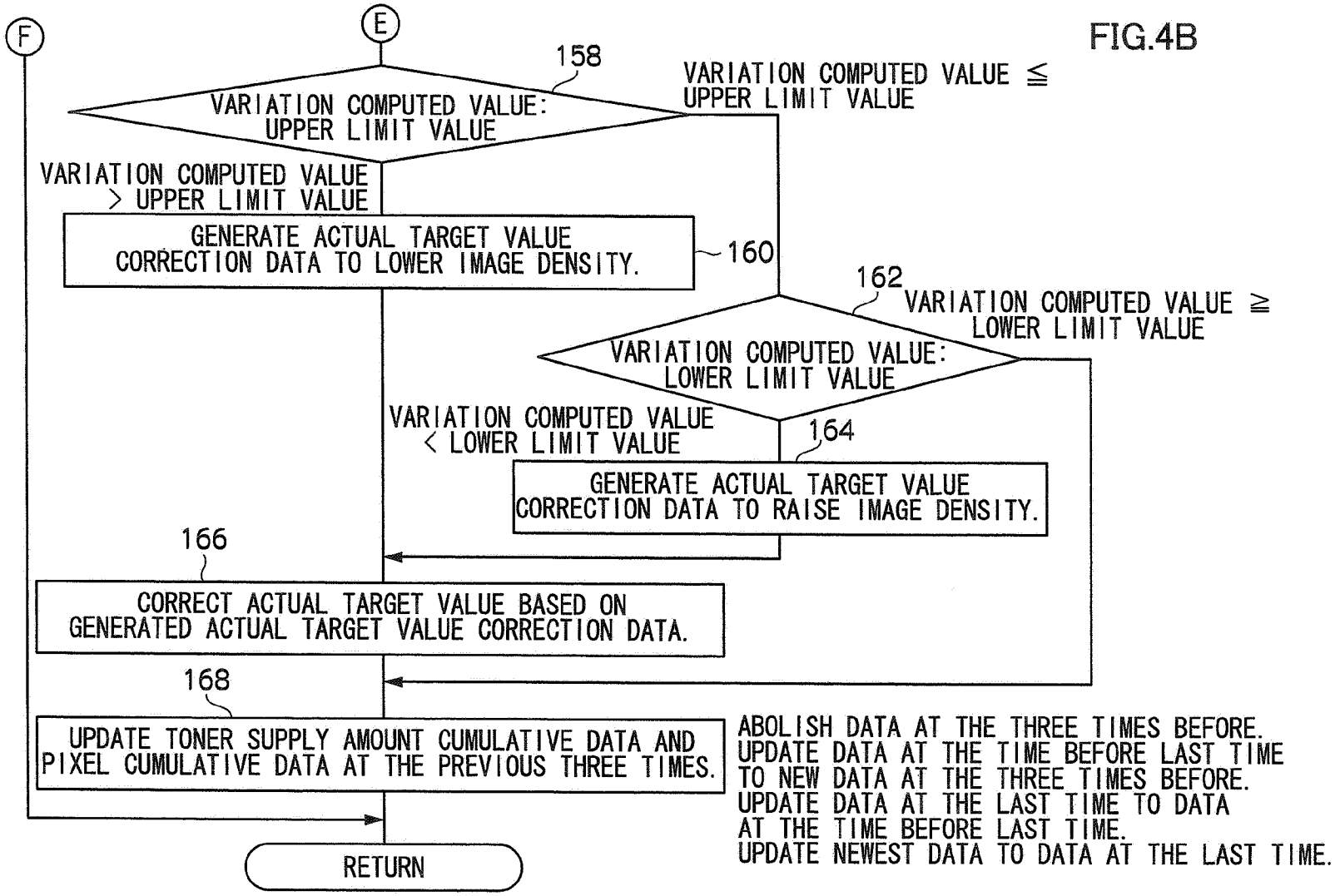

The flow of the correction control of the aforementioned actual target value will be described with reference to the flow chart shown in FIG. 4. Incidentally, the flow chart of FIG. 4 is started at each job end.

Whether or not the pixel count cumulative data exceeds the predetermined value is determined in step 150, and in the case of a negative determination, this routine is ended. If an affirmative determination is made in step 150, the current time is determined to be the actual target value correction timing, and then the procedure proceeds to step 152.

In step 152, current (updated) toner supply amount cumulative data and pixel cumulative data are read out and in step 154, the toner supply amount cumulative data and pixel cumulative data of the previous three times (three times before, two times before, and the last time) are read out, after which the procedure proceeds to step 156.

In step 156, the variation (inclination) is computed from the read out current toner supply amount cumulative data, the read out current pixel cumulative data, and the toner supply amount cumulative data of the previous three times, the pixel cumulative data of the previous three times.

In the next step 158, the computed variation (hereinafter referred to as variation computed value) is compared with the specified value (upper limit value). If it is determined that variation computed value is larger than the upper limit value in this step 158, it is determined that the outputted image density is higher than a desired density, and the procedure proceeds to step 160. Then the actual target value correction data is generated to lower the image density, and then the procedure proceeds to step 166.

If it is determined that the variation computed value is smaller than or equal to the upper limit value in step 158, the procedure proceeds to step 162, in which the variation computed value is compared with the specified value (lower limit value).

If it is determined that the variation computed value is smaller than the lower limit value in step 162, it is determined that the outputted image density is lower than a desired density, and the procedure proceeds to step 164, in which the actual target value correction data for raising the image density is generated, and then the procedure proceeds to step 166.

If it is determined that the variation computed value is larger than or equal to the lower limit value in step 162, it is determined that the outputted image density remains a desired density, and the procedure proceeds to step 168.

In step 166, the actual target value is corrected based on the generated actual target value correction data, and the procedure proceeds to step 168. By correcting this actual target value, an optimum outputted image density can be obtained without any physical adjustment such as the adjusting of the developing bias or the adjusting of the amount of light.

In step 168, the toner supply amount cumulative data and the pixel cumulative data of the previous three times are updated. That is, the data of three times before is canceled, the data of two times before is adopted as new data of three times before; the data of last time is adopted as the data of two times before, the updated data is adopted as the data of last time, and then this routine is ended.

Figure 5:
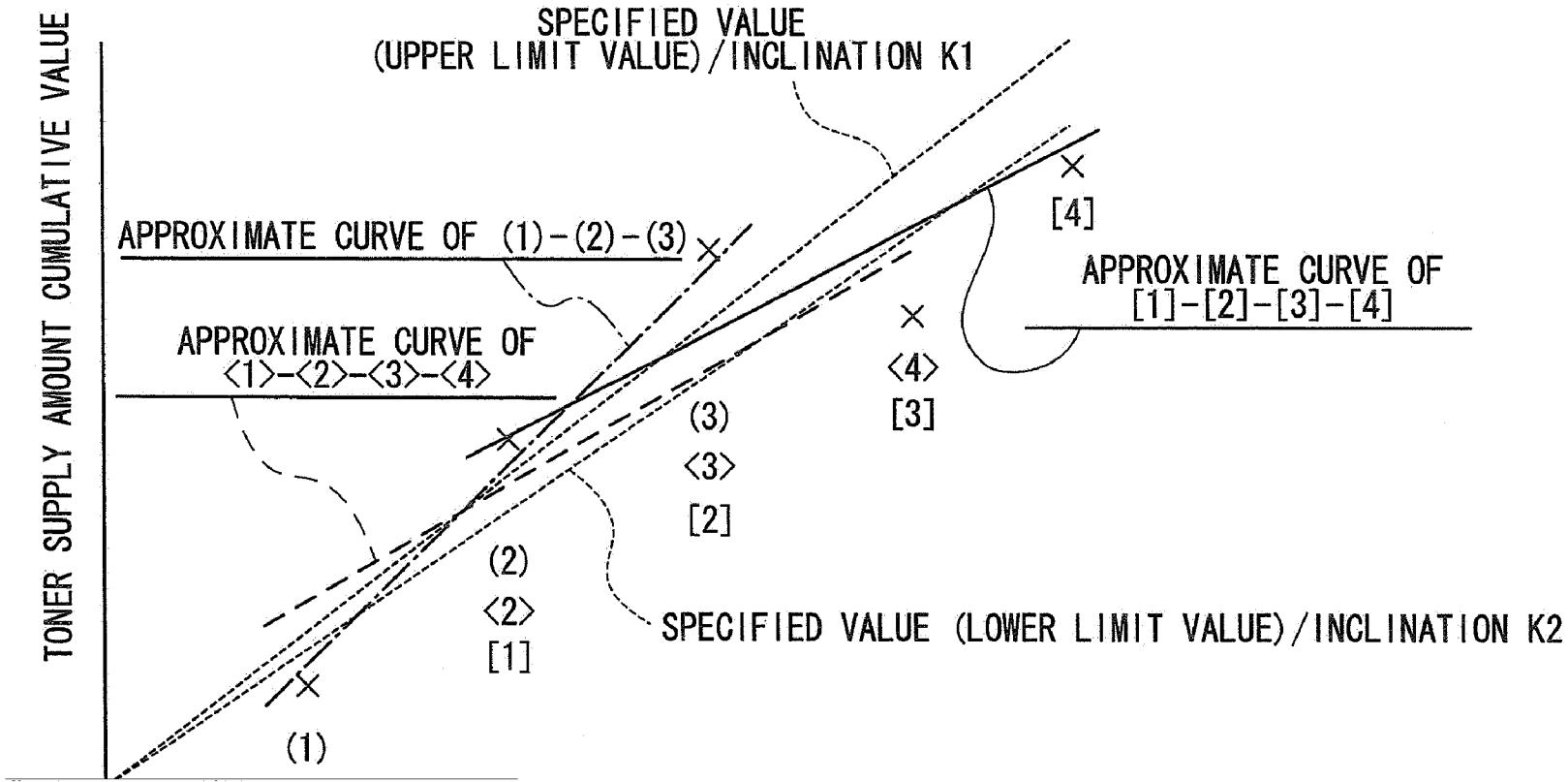
FIG. 5 is a characteristic diagram of pixel count cumulative value to toner supply amount cumulative value according to the first embodiment of the present invention.

FIG. 5 is a diagram for explaining an example of the actual target value correction of the first embodiment.

When the specified amount of accumulated image dots is exceeded after the toner cartridge is replaced, the accumulated image dots amount 1 and the accumulated toner supply amount 1 at that time are stored (see (1)).

When a next specified amount of accumulated image dots is exceeded, the last accumulated image dots amount 1 and the last accumulated toner supply amount 1 are stored as the accumulated image dots amount 2 and accumulated toner supply amount 2, and then the accumulated image dots amount and the accumulated toner supply amount (see (2)) at that time are stored respectively as the accumulated image dots amount 1 and the accumulated toner supply amount 1.

Further, when a next specified amount of accumulated image dots is exceeded, the accumulated image dots amount 2 and the accumulated toner supply amount 2 of the two times before are stored as the accumulated image dots amount 3 and the accumulated toner supply amount 3. Likewise, the accumulated image dots amount 1 and the accumulated toner supply amount 1 of the last time are stored as the accumulated image dots amount 2 and the accumulated toner supply amount 2, and the accumulated image dots amount and the accumulated toner supply amount (see (3)) at that time are stored as the accumulated image dots amount 1 and the accumulated toner supply amount 1.

Because data of three or more times is (see (1) and (3)), an approximate expression of the inclination of the accumulated image dots amount and the accumulated toner supply amount is computed using these three values according to the least square method. The inclination A based on this approximate expression is compared with the inclination k1 which is an upper limit value of the inclination of the preliminarily set accumulated image dots amount and the accumulated toner supply amount and the inclination k2 which is a lower limit value of the accumulated image dots amount and the accumulated toner supply amount, and if the inclination A is larger than the inclination k1, the target value of the outputted image density is corrected to be lower, and if the inclination A is smaller than the inclination k2, the target value of the outputted image density is corrected to be higher.

When the target value of the outputted image density is corrected to be lower, the consumption of toner is suppressed so that the accumulated toner supply amount relative to the accumulated image dots amount increases excessively. As a result, the toner density of the apparatus is increased. Because the apparatus suppresses the toner supply amount in order to correct the toner density, the accumulated toner supply amount is suppressed.

In contrary, because, if the target value is corrected to be higher, the consumption of toner is accelerated and the accumulated toner supply amount relative to the accumulated image dots amount is decreased excessively, the toner density of the apparatus is lowered. To correct this, the apparatus accelerates the supply of toner so that the accumulated toner supply amount is increased.

Further, when the next specified amount of accumulated image dots is exceeded, the accumulated image dots amount 3 and the accumulated toner supply amount 3 of three times before are stored as the accumulated image dots amount 4 and the accumulated toner supply amount 4 (see <1>), the accumulated image dots amount 2 and the accumulated toner supply amount 2 of two times before are stored as the accumulated image dots amount 3 and the accumulated toner supply amount 3 (see <2>), the accumulated image dots amount 1 and the accumulated toner supply amount 1 of the last time are stored as the accumulated image dots amount 2 and the accumulated toner supply amount 2 (see <3>), and the updated values are stored as the accumulated image dots amount 1 and the accumulated toner supply amount 1 (see <4>).

An approximate expression of the inclination of the accumulated image dots amount and the accumulated toner supply amount is computed using these four values (see <1>-<4>) according to the least square method. If, as a result of comparing the inclination A of this approximate expression with the above-described k1 and k2, the inclination A is larger than the inclination k1, the target value of the outputted image density is corrected to be lower, and if the inclination A is smaller than the inclination k2, the target value of the outputted image density is corrected to be higher.

By updating the value using a next specified amount of accumulated image dots and correcting the outputted image density using the updated four points in this manner, the inclination A is changed so that the inclination A becomes smaller than the inclination k1 and larger than the inclination k2. As a result, the image density can be controlled into a specified range.

According to the first embodiment as described above, by forming a patch image for the outputted image density correction periodically and detecting the density of this patch image with the density sensor 224 so as to compare its detection value with a preliminarily set target value, the outputted image density correction for correcting the amount of light and the developing bias is executed. On this premise, the variation of the toner supply amount cumulative value with respect to the pixel cumulative data is computed, and whether or not the variation maintains its predetermined value (in a range from the upper limit value to the lower limit value) is determined. If the variation exceeds the upper limit value, the actual target value is corrected so as to lower the outputted image density and if the variation is below the lower limit value, the actual target value is corrected to raise the outputted image density. As a consequence, an appropriate outputted image density can be maintained over a long period.

(Modification)

Although the first embodiment has been described in a state in which the toner supply amount cumulative data and the pixel cumulative data of the previous three times are stored, naturally, the transition period sometimes has less previous data (data of two times or less). In this case, while it is permissible not to execute the target value correction until the data of the previous three times is gathered, it is also permissible, for example, to compute the variation from the data of the previous two times.

Figure 6:
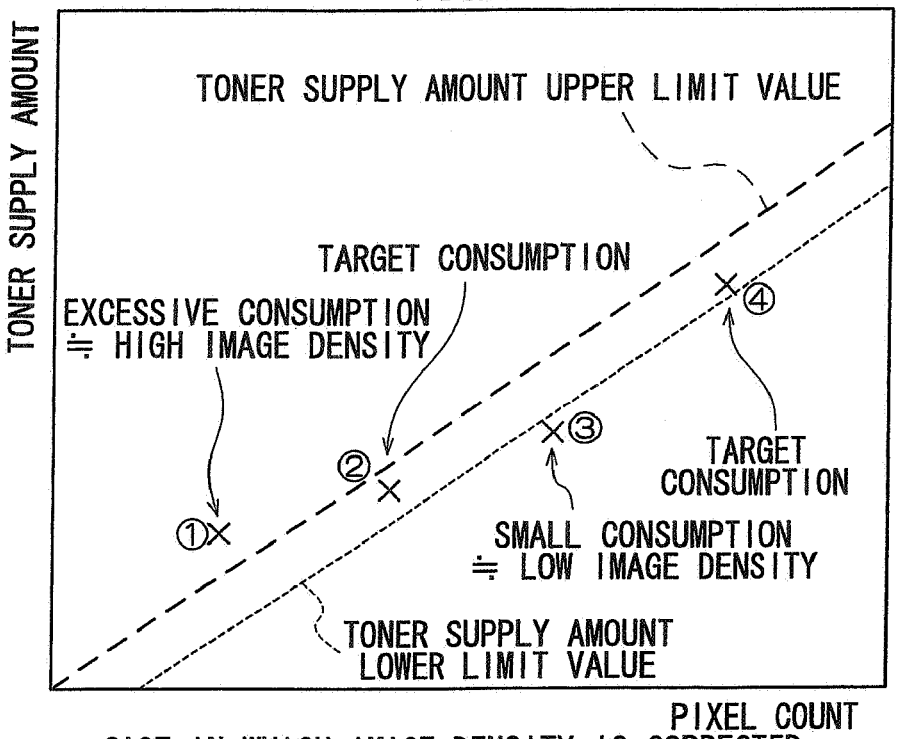
FIG. 6 is a characteristic diagram of pixel count cumulative value to toner supply amount cumulative value according to a modification of the first embodiment of the present invention.
Figure 7:
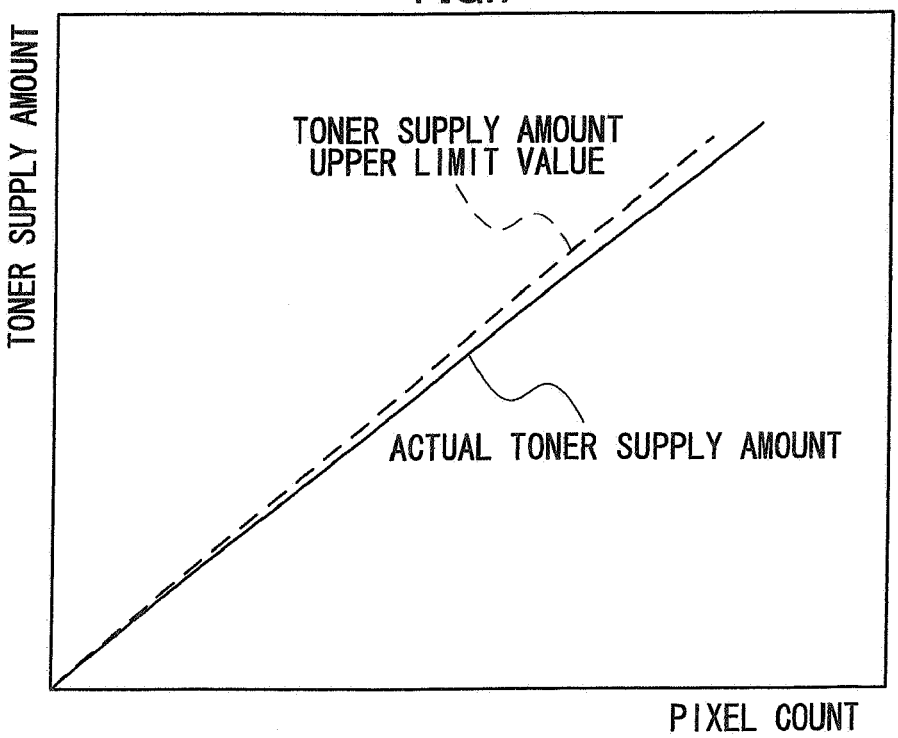
FIG. 7 is a characteristic diagram of pixel count cumulative value to toner supply amount cumulative value for explaining the principle of a first aspect of the invention.
Figure 8:
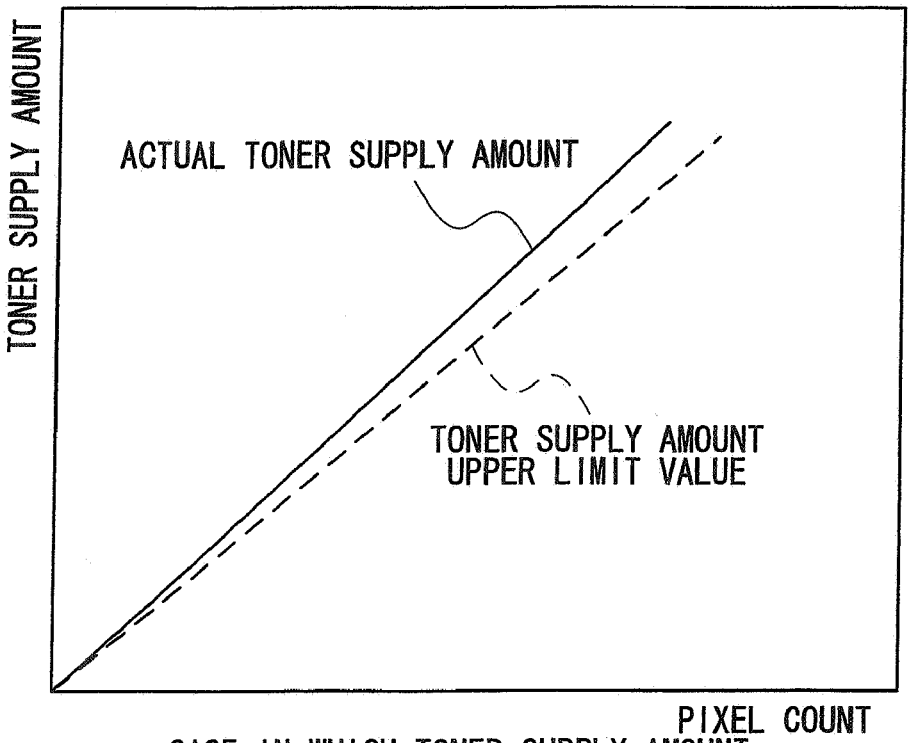
FIG. 8 is a characteristic diagram of pixel count cumulative value to toner supply amount cumulative value for explaining the principle of the first aspect of the invention.
Figure 9:
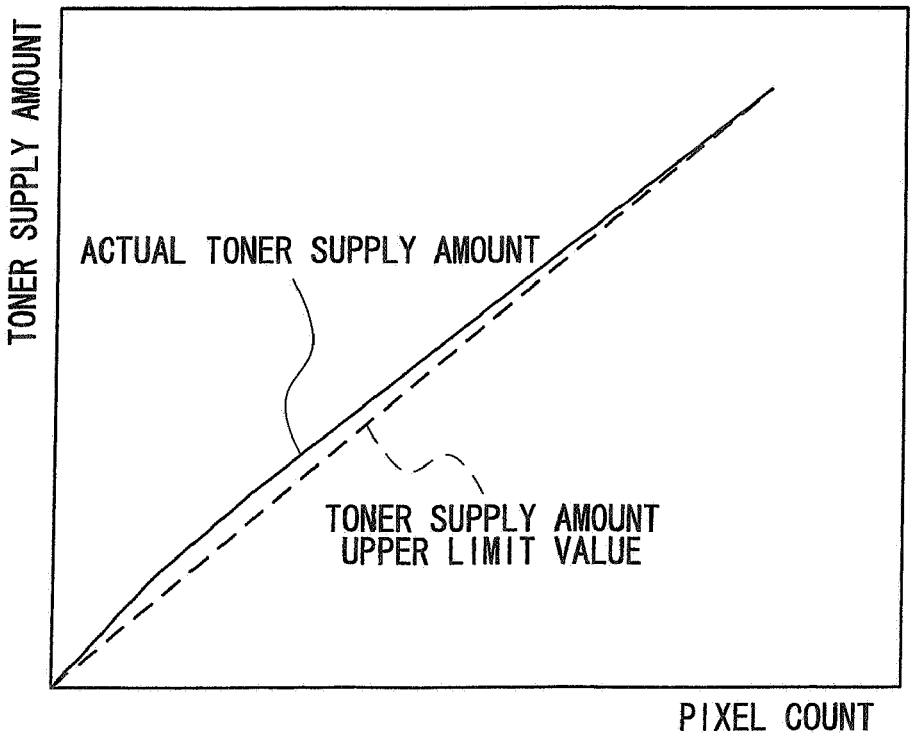
FIG. 9 is a characteristic diagram of pixel count cumulative value to toner supply amount cumulative value for explaining the principle of the target value correction of the first aspect of the invention.
Figure 10:
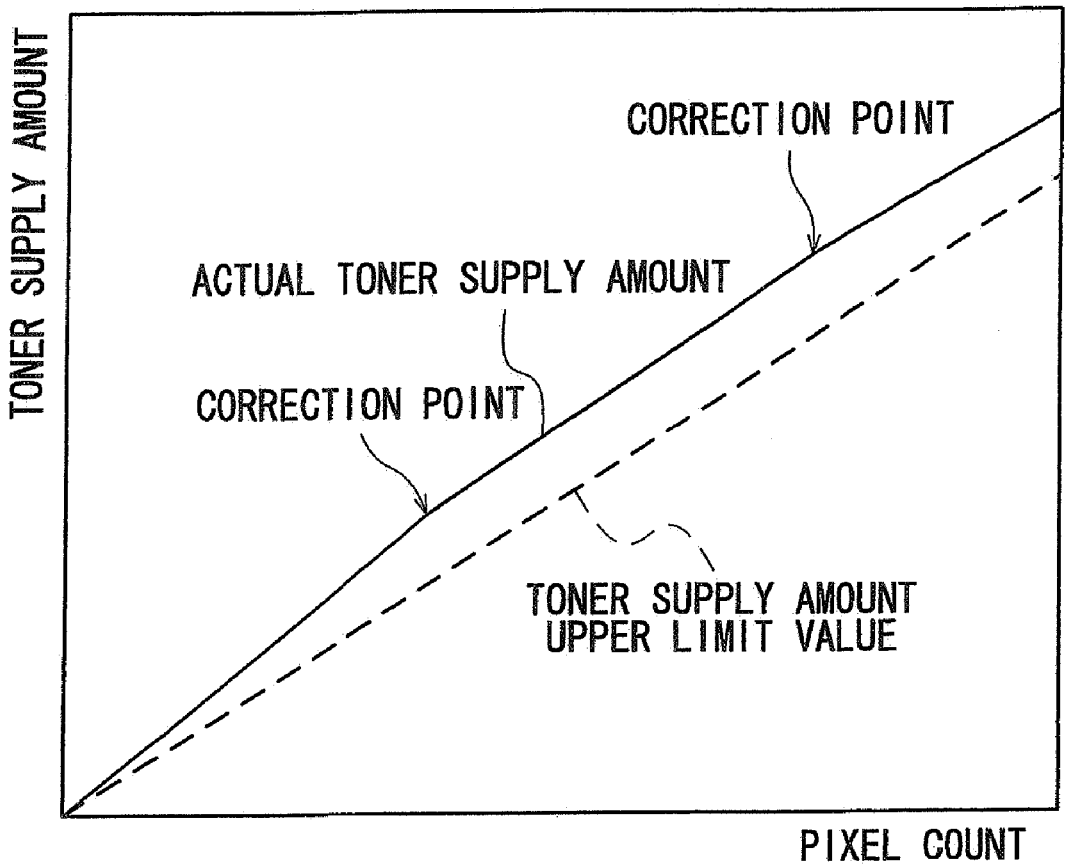
FIG. 10 is an enlarged diagram of FIG. 9.

Further, in the first embodiment, although the correction data for the target value is generated based on the variation, just the toner supply amount cumulative data (absolute amount) may be corrected (similar to ON/OFF control) by comparing it with the specified values (upper limit value and lower limit value)as shown in FIG. 6.

FIG. 6 is a diagram showing the first embodiment, in which the abscissa axis indicates the accumulated image dots amount and the ordinate axis indicates the accumulated toner supply amount. Two dashed lines indicate the upper limit value and the lower limit value of the accumulated toner supply amount at the accumulated image dots amount at that time. If the actual accumulated toner supply amount exceeds the upper limit value, it indicates that the outputted image density is too high, and conversely, if the actual accumulated toner supply amount is below the lower limit value, it indicates that the outputted image density is too low.

According to the first embodiment, the accumulated toner supply amount at the actual accumulated image dots amount is compared with its upper limit value and lower limit value at a predetermined timing, and if the actual accumulated toner supply amount is over the upper limit value, the outputted image density target value is corrected in the direction of lowering the outputted image density, and conversely, if the actual accumulated toner supply amount is below the lower limit value, the outputted image density target value is corrected in the direction of raising the outputted image density.

Because the accumulated toner supply amount is over the upper limit value at the predetermined timing (see "1" with a circle in FIG. 6) in FIG. 6, the correction is carried out in the direction of lowering the outputted image density target value. Next, because the accumulated toner supply amount is located between the upper limit value and the lower limit value at the predetermined timing (see "2" with a circle in FIG. 6), the outputted image density target value is not corrected. Next, because the accumulated toner supply amount is below the lower limit value at the predetermined timing (see "3" with a circle in FIG. 6), the correction is carried out in the direction of raising the outputted image density target value. Further, because the accumulated toner supply amount is located in the target range at the predetermined timing (see "4" with a circle in FIG. 6) again, correction of outputted image density target value is not executed.

In this way, the accumulated toner supply amount is compared with the upper and lower limit values each time at the predetermined timing so as to determine the necessity of the correction of the outputted image density target value.

In this case, although the accuracy of the correction of the actual target value is lowered, the control system is simplified, and thus this condition is optimum for correcting the actual target value simply (for example, in the case of a machine type or the like which is inexpensive and in which precise image quality is not requested).

EXAMPLE

For example, the predetermined amount of pixels is assumed to be 1 as the accumulated image dots amount. More specifically, such a value for providing five image dots on a A4 size paper at about 1% printing density is used.

Therefore, if using a toner cartridge capable of printing 8000 sheets of paper with images on the A4 size paper at 5% printing density, the accumulated image dots amount is 5×5×8000=200000 dots.

For example, if the specified accumulated image dots amount is set to 12500, the toner supply amount cumulative value is updated every time the accumulated image dots amount increases by 12500 to 12500, 25000, and 37500. Although the interval of the accumulated image dots amount is set constant, the internal does not always need to be constant but instead may be shortened just after the use of the toner cartridge is started and may be lengthened just before the use of the toner cartridge is ended.

The toner cartridge discharges toner into the developing device from a toner discharge port of the toner cartridge by driving a coil auger provided internally with a dispensing motor in which each color is disposed independently.

The toner supply amount is measured by the aforementioned dispensing frequency. When the dispensing motor rotates for 0.5 seconds, the dispensing frequency is counted as one time so that about 1800 counts is needed to supply all of the toner in the toner cartridge.

The dispensing frequency is monitored as the accumulated toner supply amount instead of the accumulated image dot interval of 12500, and every time the dispensing frequency exceeds 100 times, the accumulated image dots amount is to be updated.

Although the interval of the accumulated toner supply amount is set constant, it does not always need to be constant but instead may, for example, be shortened just after the use of the toner cartridge is started and may be lengthened just before the use is ended.

According to the first example, the accumulated printed sheets amount set in the memory is counted up every time one sheet is printed. Further, according to the first example, the accumulated image dots amount and the accumulated toner supply amount are updated every time the accumulated printed sheets amount exceeds 500, instead of the accumulated image dot interval of 12500 in example 2.

Although the interval of the accumulated printed sheets amount is set constant, it does not always need to be constant but instead may be shortened just after the use of the toner cartridge is started and may be lengthened just before the use is ended.

This apparatus has a mechanism for resetting the correction of the target value of the outputted image density when the toner cartridge is replaced.

In the image forming apparatus, the value 1.3 is stored at address A on the memory as an initial value of the target value of the outputted image density for yellow. According to example 4, if the target value of the outputted image density is lowered 0.05 by correction based on the relation between the accumulated image dots amount and the accumulated toner supply amount when the accumulated printed sheets amount exceeds 1500, −0.05 is stored at address B on the memory as a correction value. The target value of the outputted image density after 1500 sheets becomes 1.25 by summing up the values at address A and address B.

The value at address B on the memory is updated every 500 sheets, and if it is assumed that the correction value of address B on the memory is −0.15 when the toner in the toner cartridge runs out, the target value of the outputted image density is 1.15.

If the toner cartridge is replaced with a new one, the image forming apparatus detects that the toner cartridge is new from information in a memory provided in the toner cartridge. If it is detected that the toner cartridge has been replaced, the image forming apparatus resets the value at address B on the memory to 0. Thus, when the toner cartridge is replaced with a new one, the target value of the outputted image density returns to the initial value of 1.3.

Although address B is disposed on the memory of the image forming apparatus, address B may be disposed on a memory of the toner cartridge. Because the correction value is set in combination with the toner cartridge, even if a toner cartridge which has been partially used is reused, that cartridge can be used continuously from this correction value because the correction value when the cartridge was used last is recorded.

The image density target value is corrected when the accumulated toner supply amount at the predetermined accumulated image dots amount exceeds the standard value or lowers below the standard value three times consecutively.

If the accumulated toner supply amount at the predetermined timing exceeds a preliminarily set standard value three times consecutively, correction is made to lower the image density target value. Conversely, if it lowers below the standard value three times consecutively, correction is executed to raise the image density target value. If any status of exceeding the standard value or lowering below the standard value does not continue three times consecutively, such as in the case of over-below-over, no correction is made.

Second Embodiment

Hereinafter, the second embodiment of the second aspect of the invention will be described.

In the second embodiment, the same symbols are used for constituent parts that are the same as in the first embodiment, and description of the structure thereof is omitted.

The feature of the second embodiment exists in target value correction which is specialized in the apparatus operation transition period from just after shipment from the factory up to image forming processing for several hundreds sheets in the image forming apparatus 10 of the first embodiment. That is, this correction period is a period which does not overlap with the target value correction period of the first embodiment.

Figure 11:
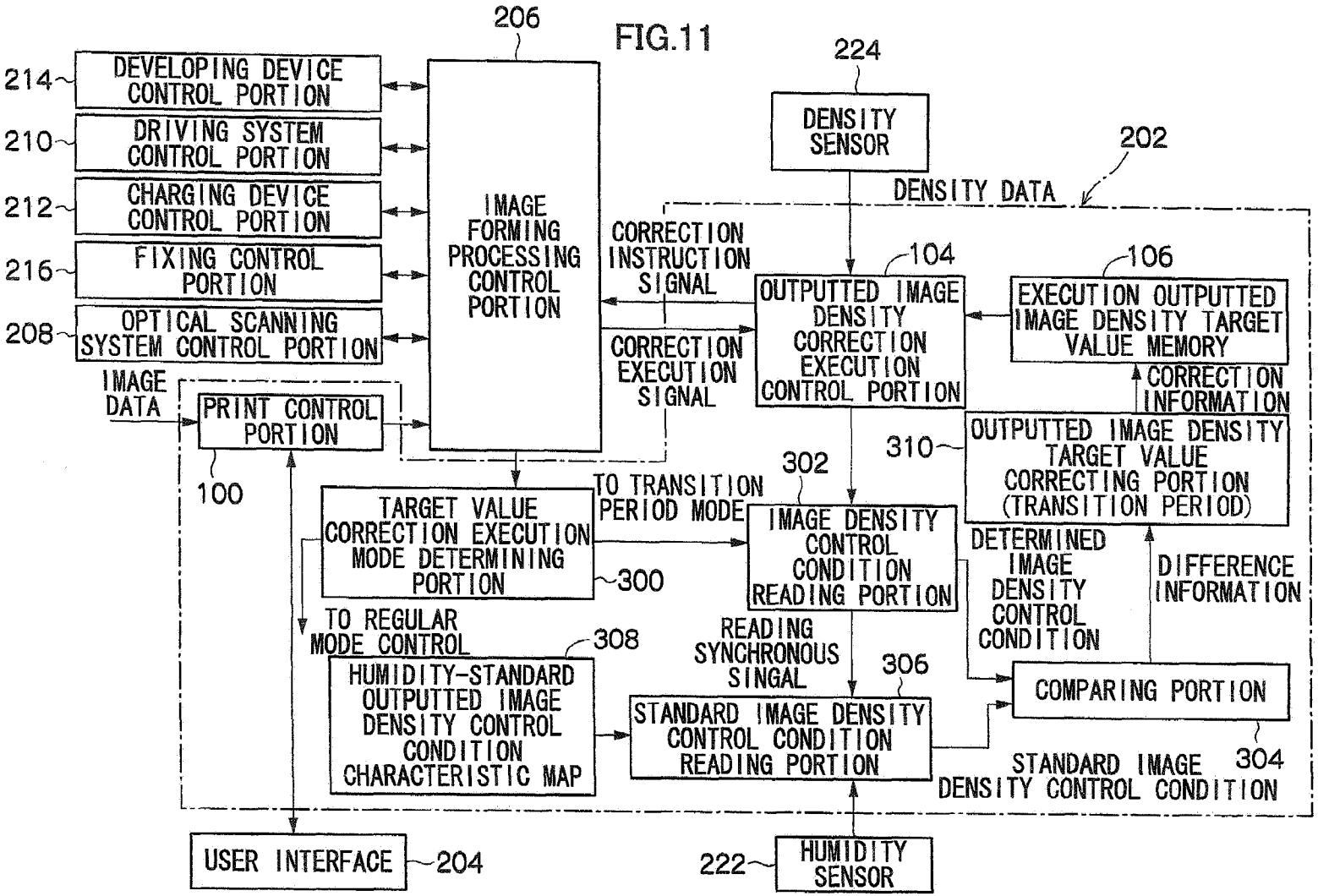
FIG. 11 is a block diagram showing the outputted image density correction control and the actual target value correction control (transition period) functionally in the main controller according to a second embodiment of the present invention.

FIG. 11 is a block diagram showing the actual target value correction control by the main controller 202 in the apparatus transition period functionally. Incidentally, although the main controller 202 executes the actual target value correction control of the regular period indicated in the first embodiment, FIG. 11 omits part of it. Further, similarly to FIG. 3, this block diagram also does not specify any hardware.

The main controller 202 is provided with a target value correction execution mode determining portion 300, which determines whether a current time is the apparatus operation transition period or the regular period based on information such as the image forming processing history from the image forming processing control portion 206.

If this target value correction execution mode determining portion 300 determines that the current time is the regular period, the regular mode control (first embodiment) is carried out. In this case, the apparatus operation transition period control program and the regular period control program may be stored beforehand and read out selectively and executed. Alternatively, each control system may be constructed with hardware and any control system may be started.

An image density control condition reading portion 302 is connected to the target value correction execution mode determining portion 300. If a signal indicating the transition period mode is inputted from the target value correction execution mode determining portion 300 to this image density control condition reading portion 302, the image density control condition reading portion 302 reads out a determined image density control condition from an outputted image density correction execution control portion 104 and sends it to a comparing portion 304.

A standard image density control condition reading portion 306 is connected to the image density control condition reading portion 302. When a determined image density control condition is read out by the image density control condition reading portion 302, a reading synchronous signal is inputted synchronously to the standard image density control condition reading portion 306 from the image density control condition reading portion 302.

Figure 12:
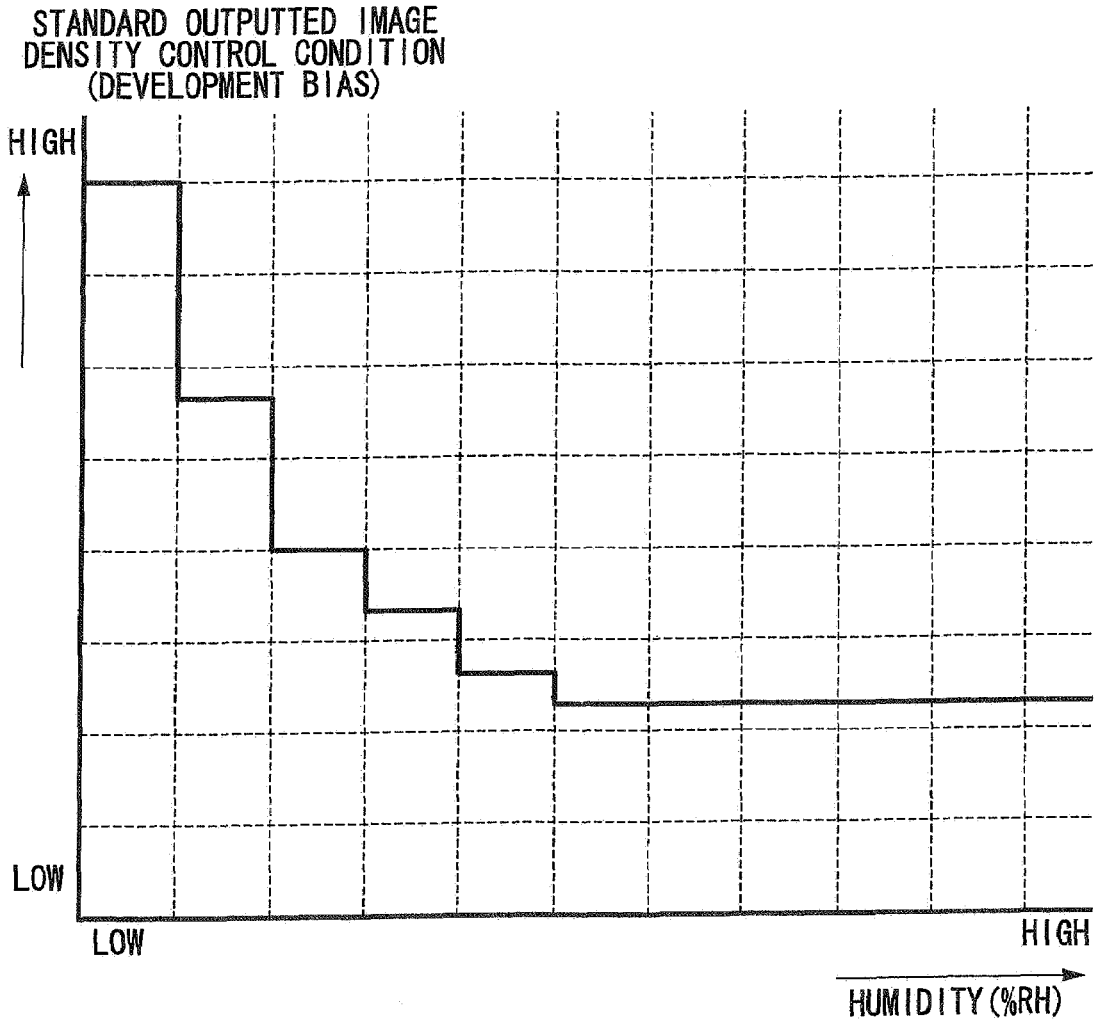
FIG. 12 is a characteristic diagram of humidity to standard outputted image density control condition (developing bias) according to the second embodiment of the present invention.

The standard image density control condition reading portion 306 reads out humidity data from a humidity sensor 222 based on this reading synchronous signal and according to the read out humidity data, a standard outputted image density control condition corresponding to the humidity is read out from a humidity-standard outputted image density control condition characteristic map 308 (see FIG. 12) and sent to the comparing portion 304.

If a difference between the determined image density control condition and the standard outputted image density control condition is more than a predetermined value (out of a range set independently on the plus side ($\alpha$) and the minus side ($\beta$)), the comparing portion 304 sends difference information to an outputted image density target value correcting portion (transition period) 310 in order to correct the outputted image density target value.

This outputted image density target value correcting portion (transition period) 310 may be shared because it has the same function as the outputted image density target value correcting portion 108 (see FIG. 3) of the first embodiment.

The outputted image density target value correcting portion (transition period) 310 sets an outputted image density target value corresponding to the difference information and stores the updated correction information in the execution outputted image density target value memory 106.

As a result, the outputted image density correction by the outputted image density correction execution control portion 104 is executed based on the updated target value.

Figure 13:
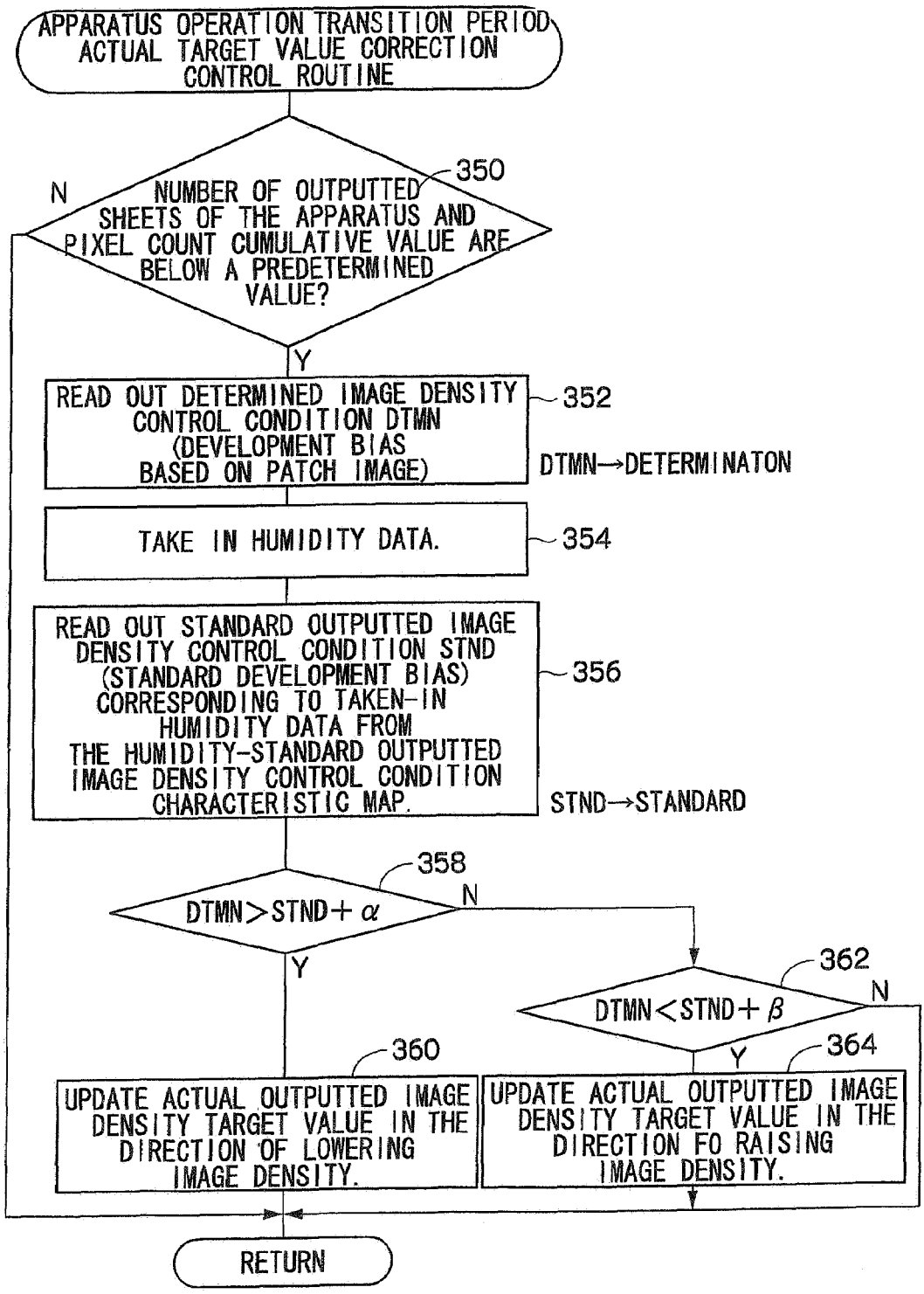
FIG. 13 is a flow chart showing the flow of the correction control of the actual target value according to the second embodiment of the present invention.

The operation of the second embodiment will be described with reference to the flow chart in FIG. 13.

Whether or not the output amount for image forming processing by the apparatus is below a predetermined value and whether or not the pixel count cumulative value is below a predetermined value are determined in step 350, and if a negative judgment is made, it is determined that the current time is the regular time, and this routine is ended.

If an affirmative judgment is made in step 350, it is determined that the current time is the apparatus operation transition period, and the procedure moves to step 352.

The determined image density control condition DTMN determined by the outputted image density correction execution control portion 104 is read out in step 352. More specifically, this is the developing bias corrected by feedback by detecting the patch image.

In the next step 354, humidity data detected by the humidity sensor 222 is taken in, and the procedure proceeds to step 356, in which the developing bias corresponding to the taken-in humidity data is read out from a humidity-developing bias characteristic map (humidity-standard outputted image density control condition characteristic map), and then the procedure proceeds to step 358.

In step 358, the determined image density control condition DTMN and the standard outputted image density control condition STND are compared with each other. If DTMN>STND $+\alpha$, because the possibility that the image density is intensified is high, the procedure proceeds to step 360, in which the execution outputted image density target value is updated in the direction of lowering the image density (lowering the developing bias).

On the other hand, if it is determined that DTMN$\leqq$STND $+\alpha$ in step 358, the procedure proceeds to step 362, in which the determined image density control condition DTMN and the standard outputted image density control condition STND are compared with each other again. If it is determined that DTMN<STND $+\beta$ in this step 362, because the possibility that the image density is lowered is high, the procedure proceeds to step 364, in which the execution outputted image density target value is updated in the direction of intensifying the image density.

If it is determined that DTMN$\geqq$STND $+\beta$ in step 362, this routine is terminated without updating the target value because the image density is appropriate.

According to the second embodiment, as described above, in the apparatus operation transition period in which the relation between the image and the toner consumption amount can not yet be grasped, the standard outputted image density condition (developing bias here) based on the environmental condition (humidity here) is stored on a premise that the toner cartridge is new and the toner density is known and the target value is updated based on the difference between this standard outputted image density condition and the image density output condition (developing bias) determined by actually reading a patch image.

As a result, the target value can be converged to a stable value in a relatively short period, so that just after the regular period starts, high accuracy image density correction is enabled.

Correcting the target value every time the outputted image density correction is executed in this apparatus operation transition period prevents the dispersion of the patch image density from making influence easily when the toner charging condition is unstable, particularly after the installation of the apparatus, and enables the image density to approach the target value.

Further, using humidity as the environmental condition allows the influence of toner whose charging condition changes depending on humidity to be compensated for.

Although the second embodiment automatically executes the correction of the target value every time the outputted image density correction is executed in the apparatus operation transition period, this may be manually executed according to the instruction of an operator from the user interface 204. As a consequence, if the automatic correction is insufficient, the target value correction can be executed rapidly according to the judgment of the operator.

Furthermore, although the second embodiment automatically executes the correction of the target value every time the outputted image density correction is executed in the apparatus operation transition period, the execution interval of the outputted image density correction may be changed if the target value is updated or depending on the degree of the update.

Third Embodiment

Figure 14:
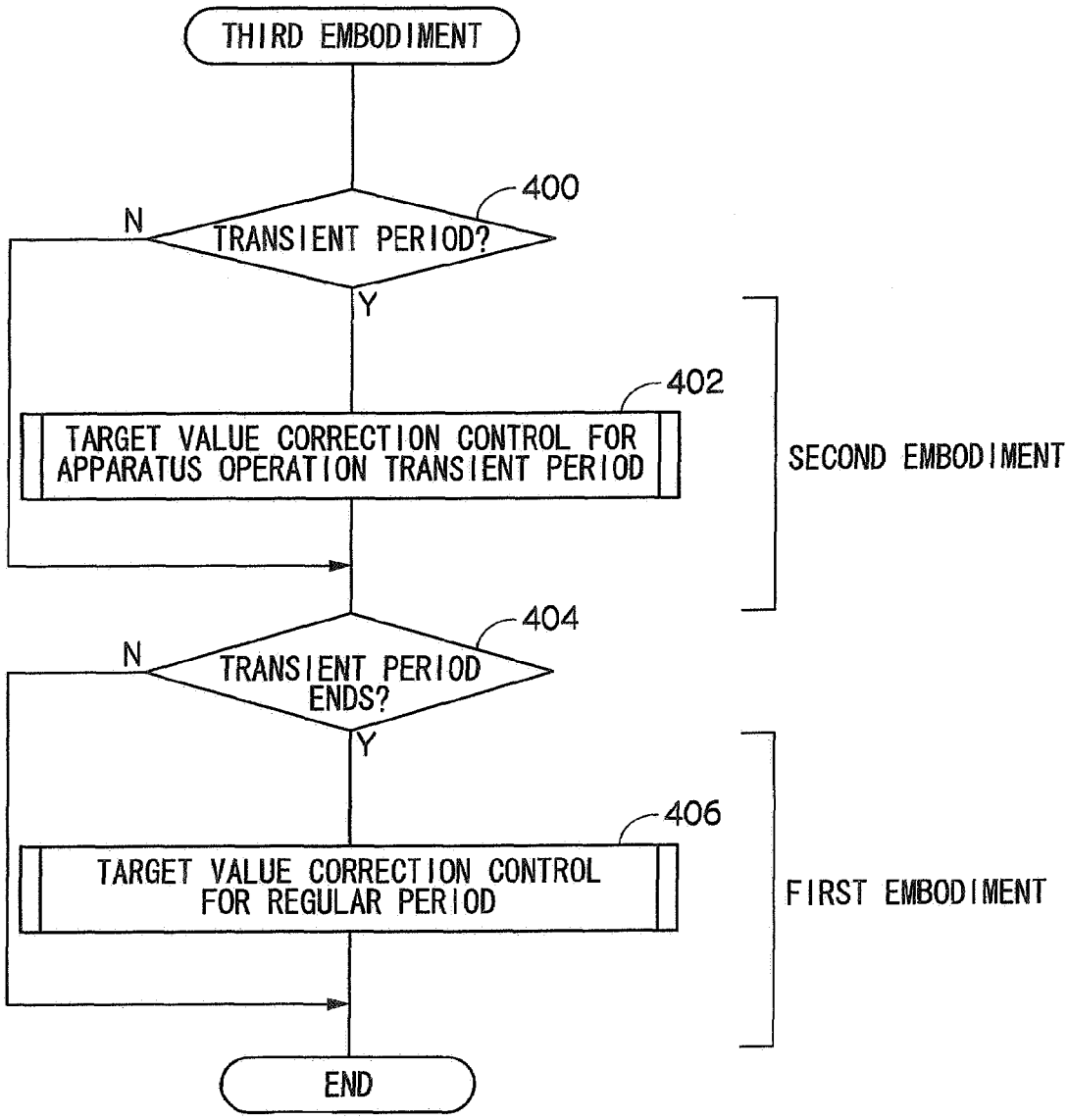
FIG. 14 is a flow chart showing the flow of the target value correction control of the apparatus operation transition period and the regular period according to a third embodiment of the present invention.

Hereinafter, the third embodiment of the invention will be described. The third embodiment is a combination of the first aspect and the second aspect of the invention, in which in a single apparatus, as shown in FIG. 14, the apparatus operation transition period target value correction control is executed (step 402) in the apparatus operation transition period (affirmative determination in step 400) and when the transition period ends and the regular period starts (affirmative determination of step 404), the regular period target value correction control is executed (step 406).

As a result, stable outputted image density correction is enabled under all conditions from the transition period just after the shipment of a single image forming apparatus up to the regular period thereby leading to the improvement of the image quality.

Although the toner cartridge 64 has not been explained in detail in the first embodiment to the third embodiment, the toner cartridge 64 can be applied to the invention not only through a structure filled with only the developing agent but also through a structure integrated with other image forming functional members (for example, a photo conductor drum).

The above-described embodiments are just some examples, and it should be understood that the invention can be modified in various ways within the scope thereof.

In the first aspect of the invention, the target value correction by the target value correcting portion may be executed every time the pixel count accumulation value stored in the pixel count value accumulating memory portion exceeds a predetermined value.

Because the outputted image density target value can be corrected at a predetermined pixel count interval, the consumption of toner can be corrected at an equal interval so that effective and accurate correction can be expected.

In the first aspect of the invention, the target value correction by the target value correcting portion may be executed every time the toner supply amount accumulation value stored in the toner supply amount accumulating memory portion exceeds a predetermined value.

Because the outputted image density target value can be corrected at a predetermined toner supply amount interval, the correction interval can be achieved by an easier method.

In the first aspect of the invention, an accumulated printed sheets amount memory portion that stores an accumulated printed sheets amount may be further included, wherein the target value correction by the target value correcting portion may be executed every time the accumulated printed sheets amount stored in the accumulated printed sheets amount memory portion exceeds a predetermined value.

Because the outputted image density target value can be corrected at a predetermined printed sheets amount interval, the correction interval can be set most easily. Further, because the printed sheets amount at which correction is to be corrected is clear, the effect of the correction can be verified easily.

In addition, in the first aspect of the invention, a toner cartridge may be loaded on the developing device or an image forming apparatus main body and the data corrected by the target value correcting portion may be reset by replacing the toner cartridge.

Because the correction executed up to then can be reset by replacing the toner cartridge, the optimum correction can be executed with respect to the cartridge even if the development characteristics differ largely among cartridges.

Further, in the first aspect of the invention, a variation may be computed from the pixel count accumulation value stored in the pixel count value accumulation memory portion and the toner supply amount stored in the toner supply amount accumulation memory portion; the variation may be compared with a variation of the toner supply amount accumulation value at the preliminarily set pixel count accumulation value; and when the comparison result diverges by more than a certain value, the target value correcting portion corrects the target value in the direction of suppressing the apart state.

Because the variation (inclination) of the toner supply amount cumulative value to the pixel count cumulative value can be adjusted to a preliminarily set variation, the outputted image density can be adjusted to the target value, and at the same time, the generation of such a problem that the service life of the toner cartridge cannot be achieved due to high outputted image density can be suppressed. Another feature is that a system highly resistant to dispersion of the toner supply amount cumulative value can be easily constructed.

In addition, in the first aspect of the invention, upper and lower limit values may be set preliminarily for the toner supply amount accumulation value at the pixel count accumulation value; and when the toner supply amount accumulation value at the pixel count accumulation value is outside of the upper and lower limit values, the target value correcting portion corrects the target value in the direction of bringing the toner supply amount accumulation value within the range specified by the upper and lower limit values.

Because the outputted image density is corrected by comparing the toner supply amount cumulative value at a predetermined pixel count cumulative value with its upper and lower limit values, complicated computation for computing the variation (inclination) and excess memory consumption become unnecessary. Another feature is that because the correction can be carried out from the first pixel point, an immediately effective system can be easily constructed.

Further, in the first aspect of the invention, a specified value may be set preliminarily for the toner supply amount accumulation value at the pixel count accumulation value; and when the number of times that the toner supply amount accumulation value at the pixel count accumulation value consecutively departs from the specified value exceeds a predetermined number of times, the target value correcting portion corrects the target value in the direction in which the toner supply amount accumulation value approaches the specified value.

Because the toner supply amount cumulative value at a predetermined pixel count cumulative value is compared with its standard value and the outputted image density is corrected when the actual toner supply amount cumulative value exceeds or lowers below a predetermined value consecutively a predetermined number of times, deflection of the correction due to dispersion of the toner supply amount cumulative value can be prevented.

In addition, in the first aspect of the invention, when the density of a detected patch image is apart from the target value by more than a certain value, the correction of the target value by the target value correcting portion may be prohibited.

Further, in the first aspect of the invention, a drive torque measuring portion that measures a drive torque of the toner supply portion for supplying toner to the developing device may be further included, wherein when the drive torque of the toner supply portion measured by the drive torque measuring portion is apart from a reference torque set preliminarily by more than a certain value, the correction of the target value by the target value correcting portion may be prohibited.

Because the target density correction is not executed, if a measured patch density is apart from the target value by more than a certain value or the driving torque of the toner supply device is apart from its reference torque by more than a certain value, the target density correction is not executed if the actual toner supply rate changes due to an error in the apparatus, deflection of the toner or the like, thereby preventing the occurrence of disadvantages due to executing the correction for lowering the density even though the actual density is low or conversely executing the correction for raising the density even though the actual density is high.

In the second aspect of the invention, the correction of the target value by the target value correcting portion may be executed every time the outputted image density control condition is determined by the outputted image density control portion in the apparatus operation transition period.

Because the environmental condition changes largely in the apparatus operation transition period, the correction of the target value is preferably executed every time the outputted image density control condition is determined by the outputted image density control portion.

In addition, in the second aspect of the invention, the apparatus operation transition period may be a period in which an accumulation value of an image pixel amount at the time of the image formation is below a predetermined value.

The apparatus operation transition period is specified to be a period in which the cumulative value obtained by accumulating the amount of image pixel at the time of image formation is below the predetermined value.

Further, in the second aspect of the invention, the apparatus operation transition period may be a period in which an accumulation value of the toner supplied to the developing device quantitatively is below a predetermined value.

The apparatus operation transition period is specified to be a period in which the cumulative value obtained by accumulating the amount of toner supplied to the developing device quantitatively is less than the predetermined value.

In addition, in the second aspect of the invention, when the target value is corrected, an operation period for determination of the outputted image density control condition by the outputted image density control portion may be shortened.

Existence of the correction of the target value means that the change in the environment is large and to follow up the change in the environment, the operation period for determination of the outputted image density control condition by the outputted image density control portion is shortened.

As described above, the first aspect of the invention has an excellent effect such that the outputted image density can be stabilized accurately over a long period despite scattering of the patch image and dispersion in the developing agent, photo conductor, intermediate transfer member and the like especially when the density of the patch image for the outputted image density adjustment is corrected by being compared with the target value.

The second aspect of the invention can correct the target value depending on the environmental condition specifically in the apparatus operation transition period in which the first aspect of the invention is ineffective, thereby stabilizing the outputted image density.

The third aspect of the invention enables the target value to be corrected stably in the entire apparatus operation, thereby stabilizing the outputted image density from the initial period of the apparatus operation.

What is claimed is:

1. An image forming apparatus having an image forming engine for forming an image by charging the surface of an image carrying body uniformly, forming a static latent image by irradiating a light beam to the uniformly charged image carrying body corresponding to image data, developing the image with toner by a developing device, transferring the toner image to a recording medium directly or through an intermediate transfer body and fixing the transferred toner image, the image forming apparatus comprising:

an outputted image density control portion that forms a patch image for outputted image density correction and determines an outputted image density control condition based on a comparison result of the density of the patch image with a preliminarily set target value;

a pixel count portion capable of counting the amount of image pixel at the time of image formation;

a pixel count value accumulating memory portion that accumulates and stores the pixel count value obtained by counting by the pixel count portion;

a toner supply portion capable of supplying the toner to a developing device quantitatively;

a toner supply amount measuring portion capable of measuring the amount of toner supplied to the developing device by the toner supply portion;

a toner supply amount accumulating memory portion that accumulates and stores the toner supply amount measured by the toner supply amount measuring portion; and a target value correcting portion that corrects the target value of the density of the patch image from the relation between a pixel count accumulating value stored in the pixel count value accumulating memory portion and a toner supply amount accumulation value stored in the toner supply amount accumulating memory portion.

2. The image forming apparatus of claim 1, wherein the target value correction by the target value correcting portion is executed every time the pixel count accumulation value stored in the pixel count value accumulating memory portion exceeds a predetermined value.

3. The image forming apparatus of claim 1, wherein the target value correction by the target value correcting portion is executed every time the toner supply amount accumulation value stored in the toner supply amount accumulating memory portion exceeds a predetermined value.

4. The image forming apparatus of claim 1, further comprising an accumulated printed sheets amount memory portion that stores an accumulated printed sheets amount wherein the target value correction by the target value correcting portion is executed every time the accumulated printed sheets amount stored in the accumulated printed sheets amount memory portion exceeds a predetermined value.

5. The image forming apparatus of claim 1, wherein a toner cartridge is loaded on the developing device or an image forming apparatus main body and the data corrected by the target value correcting portion is reset by replacing the toner cartridge.

6. The image forming apparatus of claim 1, wherein a variation is computed from the pixel count accumulation value stored in the pixel count value accumulation memory portion and the toner supply amount stored in the toner supply amount accumulation memory portion; the variation is compared with a variation of the toner supply amount accumulation value at the preliminarily set pixel count accumulation value; and when the comparison result diverges by more than a certain value, the target value correcting portion corrects the target value in the direction of suppressing the apart state.

7. The image forming apparatus of claim 1, wherein upper and lower limit values are set preliminarily for the toner supply amount accumulation value at the pixel count accumulation value; and when the toner supply amount accumulation value at the pixel count accumulation value is outside of the upper and lower limit values, the target value correcting portion corrects the target value in the direction of bringing the toner supply amount accumulation value within the range specified by the upper and lower limit values.

8. The image forming apparatus of claim 1, wherein a specified value is set preliminarily for the toner supply amount accumulation value at the pixel count accumulation value; and when the number of times that the toner supply amount accumulation value at the pixel count accumulation value consecutively departs from the specified value exceeds a predetermined number of times, the target value correcting portion corrects the target value in the direction in which the toner supply amount accumulation value approaches the specified value.

9. The image forming apparatus of claim 1, wherein when the density of a detected patch image is apart from the target value by more than a certain value, the correction of the target value by the target value correcting portion is prohibited.

10. The image forming apparatus of claim 1, further comprising a drive torque measuring portion that measures a drive torque of the toner supply portion for supplying toner to the developing device, wherein when the drive torque of the toner supply portion measured by the drive torque measuring portion is apart from a reference torque set preliminarily by more than a certain value, the correction of the target value by the target value correcting portion is prohibited.

11. An outputted image density correcting method that is executed at a predetermined timing throughout an entire apparatus operation so as to form a patch image for outputted image density correction and determine an outputted image density control condition according to the comparison result of the density of the patch image with a preliminarily set target value, in an image forming apparatus having an image forming engine for forming an image by charging the surface of an image carrying body uniformly, forming a static latent image by irradiating a light beam to the uniformly charged image carrying body corresponding to image data, developing the image with toner by a developing device, transferring the toner image to a recording medium directly or through an intermediate transfer body and fixing the transferred toner image, the method comprising:

obtaining a difference between an environmental condition when the outputted image density control condition is determined and a standard outputted image density control condition under conditions in which the toner density is known in a preliminarily set apparatus operation transition period and correcting the target value based on the difference; and accumulating the amount of image pixels at the time of image formation in a period other than the apparatus operation transition period, accumulating the toner supply amounts supplied to the developing device and correcting the target value of the density of the patch image according to the relation between the accumulation value of the pixel amount and the accumulation value of the toner supply amount.

* * * * *